US005734379A

United States Patent [19]

Natsumi et al.

[11] Patent Number: 5,734,379

[45] Date of Patent: Mar. 31, 1998

[54] LIQUID CRYSTAL DISPLAY DEVICE

[75] Inventors: Masayuki Natsumi; Kazutomo Fujita, both of Yamatokoriyama; Toshio Nishimura, Kyoto; Masami Azuma, Nara, all of Japan

[73] Assignee: Sharp Kabushiki Kaisha, Osaka, Japan

[21] Appl. No.: 579,599

[22] Filed: Dec. 26, 1995

[30] Foreign Application Priority Data

Dec. 26, 1994 [JP] Japan ..... 6-323432
Dec. 28, 1994 [JP] Japan ..... 6-328447

[51] Int. Cl.[6] ..... G09G 5/00

[52] U.S. Cl. ..... 345/211; 345/87

[58] Field of Search ..... 345/204, 205, 345/206, 207, 208, 215, 209, 210, 211, 212, 213, 214, 87, 98

[56] References Cited

U.S. PATENT DOCUMENTS

| | | | |
|---|---|---|---|
| 4,769,639 | 9/1988 | Kawamara et al. | 340/784 |
| 5,101,116 | 3/1992 | Morokawa | 307/264 |
| 5,111,319 | 5/1992 | Morris | 359/85 |
| 5,229,761 | 7/1993 | Fase | 340/784 |
| 5,247,376 | 9/1993 | Wakai | 359/55 |
| 5,343,221 | 8/1994 | Arakawa et al. | 345/211 |
| 5,404,150 | 4/1995 | Murata | 345/95 |
| 5,510,814 | 4/1996 | Ise | 345/211 |
| 5,532,713 | 7/1996 | Okada et al. | 345/97 |
| 5,576,737 | 11/1996 | Isozaki | 345/211 |
| 5,592,191 | 1/1997 | Tsuboyama | 345/97 |

FOREIGN PATENT DOCUMENTS

| | | | |
|---|---|---|---|
| 532191 A2 | 8/1992 | European Pat. Off. | G09G 3/36 |
| 53-48416 | 5/1978 | Japan . | |
| 178930 | 7/1989 | Japan | G02F 1/133 |
| 242483 | 2/1990 | Japan | G09G 3/36 |
| 4361225 | 12/1992 | Japan | G02F 1/133 |
| 5-188881 | 7/1993 | Japan . | |

*Primary Examiner*—Kee M. Tung
*Assistant Examiner*—Matthew Luu
*Attorney, Agent, or Firm*—Nixon & Vanderhye, P.C.

[57] ABSTRACT

The present invention discloses a liquid crystal display device capable of reducing charges to be supplied from a driving circuit, increasing response speed of liquid crystals and delivering superior display. A liquid crystal display device is provided with a switching circuit between scanning electrodes of a liquid crystal display panel 25 and a common driver. The switching circuit is provided with switching elements, and each switching element is disposed between two scanning electrodes adjacent to each other. Furthermore, each switching element is turned on and off by a control means. For a predetermined period after the completion of a horizontal scanning period, a scanning electrode, to which a selection potential has been applied during the horizontal scanning period, and a scanning electrode, to which the selection potential is to be applied next are isolated once from a power supply circuit, and then electrically connected to each other by turning on the switching element so as to have an identical potential. With this structure, power to be supplied from the common driver can be reduced.

29 Claims, 11 Drawing Sheets

LIQUID CRYSTAL DISPLAY DEVICE

BACKGROUND OF THE INVENTION

1. Field of the Invention

The present invention relates to a liquid crystal display device and more particularly to a duty-drive type liquid crystal display device operable at low power consumption.

2. Description of the Related Art

As laptop computers and portable information terminals are made more compact, the liquid crystal display devices utilized therein are expected to be more compact, have lower power consumption, and have more pixels.

FIG. 12 is a block diagram showing a structure of a liquid crystal display device 1 in accordance with typical prior art practice. The liquid crystal display device 1 comprises liquid crystal display means 2, control means 3 and a power circuit 4. In addition, the liquid crystal display means 2 comprises a liquid crystal display panel 5, a data driver 6 and a common driver 7.

FIG. 13 is a circuit diagram showing a structure of the power circuit 4. As shown in FIG. 13, the power circuit 4 comprises a power generator 8, such as a battery, a DC/DC converter or the like, and a voltage divider circuit 9 for generating a plurality of potentials.

As shown in FIG. 13, in the voltage divider circuit 9, a voltage (Vee1) in the range of from a potential +Vee1 to a potential −Vee1 supplied from the power generator 8 is divided into six potentials (V1 to V6) by using at least five resistors 10 to 14, and intermediate potentials (V2 to V5) are delivered via operational amplifiers 15 to 18.

Among the generated potentials (V1 to V6), V1, V2, V5 and V6 are supplied to the common driver 7. As described later in Table 1, the potentials V1 and V6 are applied to scanning electrodes as selection potentials, and the potentials V2 and V5 are applied to the scanning electrodes as nonselection potentials. V1, V3, V4 and V6 are supplied to the data driver 6. As shown in Table 2 described later, the potentials V1 and V6 are applied to signal electrodes as ON potentials, and the potentials V2 and V5 are applied to the signal electrodes as nonselection potentials.

The control means 3 controls the data driver 6 and the common driver 7 in accordance with control signals supplied externally. The liquid crystal display panel 5 is made by interposing a liquid crystal layer between a pair of substrate members. In one of the pair of substrate members, a plurality of signal electrodes X1, X2, . . . , XL (generally referred to as X) are arranged on one surface of a transparent substrate made of glass, plastic or the like, and the entire surface on which the signal electrodes X are arranged is covered with an orientation film. Furthermore, in the other substrate member, a plurality of scanning electrodes Y1, Y2, . . . , YM (generally referred to as Y) are arranged on one surface of a transparent substrate made of glass, plastic or the like, and the entire surface on which the scanning electrodes Y are arranged is covered with an orientation film. The pair of substrate members are aligned so that the orientation films face each other and so that the signal electrodes X intersect the scanning electrodes Y, and the pair of substrate members are attached to each other with a predetermined clearance by a sealing member, and liquid crystals are disposed between the substrate members to form the liquid crystal layer. Displaying is performed by using the intersection portions of the signal electrodes X and the scanning electrodes Y as pixels.

The data driver 6 is connected to all the signal electrodes X and selectively applies ON and OFF potentials to the signal electrodes X on the basis of data to be displayed at the pixels. The common driver 7 is connected to all the scanning electrodes Y, applies a selection potential to the scanning electrodes Y sequentially in order of line arrangement at every horizontal scanning period, and applies a nonselection potential to the remaining scanning electrodes to which the selection potential is not applied.

The power circuit 4 generates the selection and nonselection potentials for the scanning electrodes Y and the ON and OFF potentials for the signal electrodes X, and supplies the potentials to each driver, and also supplies drive power to the control means 3.

In the liquid crystal display device 1 having the above-mentioned structure, a driving method, referred to as a duty drive type wherein scanning electrode voltage is changed periodically, is used to reduce current consumption by making the drive voltage for the data driver 6 lower than the drive voltage in the case of a drive method wherein scanning electrode voltage is constant. On the other hand, since the voltage application time for one pixel is made shorter as the duty ratio is made higher (because of the increase in the number of pixels constituting one horizontal line), the application voltage is made higher. Therefore, the current consumption at the scanning electrodes, in particular, at the time of selection/nonselection switching of the scanning electrodes, the charging and discharging currents flowing the pixels (regarded to be equivalent to capacitors increase. The charges applied by the data driver 6 and the common driver 7 during a display period and retained at the pixels of the liquid crystal display panel 5 are returned to the drivers 6, 7 via resistors and further returned to the power circuit 4 after the display period.

A first technology for avoiding waste of charges in liquid crystal display devices is disclosed in Japanese Unexamined Patent Publication JPA 5-188881 (1993). According to this first publication, a switching circuit to be opened and closed at a predetermined timing is connected to a common electrode and charges are returning to a power supply via a converter after a display period, thereby preventing an increase in drive power at the common electrode because of an increase in drive current at the time of inverse driving. In addition, a second technology for avoiding waste of charges is disclosed in Japanese Unexamined Patent Publication JPA 53-48416 (1978). According to this second publication, drive power consumption is reduced by periodically applying an intermediate potential to each electrode for a certain time after a display period.

In the case of the above-mentioned power circuit, wherein a conventional resistor-type voltage divider is used, since a path of current flow is from the maximum potential (V1) to the minimum potential (V6) at all times, even when current flows between intermediate potentials (from V2 to V3 for example), power to be consumed amounts to a current value×(V1−V6).

When current flows from V2 to V3 for example, power to be truly consumed only for driving liquid crystals amounts to a current value×(V2−V3). Therefore, difference in power between a current value×(V1−V6) and the current value×(V2−V3) is regarded to be lost in the power circuit.

In the liquid crystal display device disclosed in the first publication, a switching circuit and a converter are required to prevent driving power from increasing, thereby increasing parts count and production processes, thus resulting in higher production cost. Furthermore, charges are lost in circuits through which the charges pass when returning to the power circuit. In the liquid crystal display device disclosed in the second publication, the structure of electrode driving means for applying charges is complicated, thereby increasing parts count and production processes, thus resulting in higher production cost.

Besides, in the duty-drive type liquid crystal display device, since a period in which each pixel is selected is very short, the difference in voltage between the selection state and the nonselection state of the scanning electrodes becomes larger and the time for transition between the selection state and the nonselection state is apt to become shorter. In addition, since no steep voltage waveform is obtained because of resistors and protective resistors used in the drive circuit, the response speed of liquid crystals is lowered and the quality of display is deteriorated.

SUMMARY OF THE INVENTION

One object of the present invention is to provide a liquid crystal display device capable of reducing power to be supplied from drive means and offering high response speed of liquid crystals and superior display.

Another object of the invention is to provide a liquid crystal driving power supply of low power consumption capable of reducing waste of power at a power circuit.

The invention provides a liquid crystal display device comprising:

a liquid crystal display panel;

power supply means for generating n (n:an integer of 3 or more) pieces of potentials V1 to Vn (V1>V2>...>Vn); and driving means for selecting at least two potentials from the n pieces of potentials generated from the power supply means depending on an image to be displayed on the liquid crystal display panel and for supplying voltages to the liquid crystal display panel;

wherein the power supply means comprises:

n−1 pieces of power supplies for generating high potentials Vi and low potentials Vi+1 (i=1 to n−1); and voltage level arbitration means for delivering the potentials V1 to Vn by commonly connecting equal potentials among the potentials from the power supplies.

The invention provides a liquid crystal display device comprising:

a liquid crystal display panel;

power supply means for generating six potentials V1 to V6 (V1>V2>V3>V4>V5>V6); and driving means for selecting at least two potentials from the six pieces of potentials generated from the power supply means depending on an image to be displayed on the liquid crystal display panel and for supplying voltages to the liquid crystal display panel;

wherein the power supply means comprises:

a first power supply for generating high a potential V1 and a low potential V6;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and V6.

The invention provides a liquid crystal display device comprising:

a liquid crystal display panel;

power supply means for generating six potentials V1 to V6 (V1>V2>V3>V4>V5>V6); and driving means for selecting at least two potentials from the six pieces of potentials generated from the power supply means depending on an image to be displayed on the liquid crystal display panel and for supplying voltages the liquid crystal display panel;

wherein the power supply means comprises:

a first power supply for generating a high potential V3 and a low potential V4;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and V6.

The invention provides a liquid crystal display device comprising:

a liquid crystal display panel;

power supply means for generating six potentials V1 to V6 (V1>V2>V3>V4>V5>V6); and driving means for selecting at least two potentials from the six pieces of potentials generated from the power supply means depending on an image to be displayed on the liquid crystal display panel and for supplying voltages to the liquid crystal display panel;

wherein the power supply means comprises:

a first power supply for generating a high potential V1 and a low potential V4;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and. V6.

The invention provides a liquid crystal display device comprising:

a liquid crystal display panel;

power supply means for generating six potentials V1 to V6 (V1>V2>V3>V4>V5>V6); and driving means for selecting at least two potentials from the six pieces of potentials generated from the power supply means depending on an image to be displayed on the liquid crystal display panel and for supplying voltages to the liquid crystal display panel;

wherein the power supply means comprises:

a first power supply for generating a high potential V1 and a low potential V6, a second power supply for generating a high potential V3 and a low potential V4, and voltage level arbitration means for creating and delivering the six potentials V1 to V6 on the basis of the potentials from the first and second power supplies;

wherein the voltage level arbitration means comprises:

a first signal line to which the potential V1 is supplied;

a second signal line to which the potential V4 is supplied;

a third signal line to which the potential V3 is supplied;

a fourth signal line to which the potential V6 is supplied;

a first switching element disposed between the first and second signal lines, turned on and off by an alternating signal for specifying a timing for inverting the polarity of the voltage to be applied to the liquid crystal display panel; and a second switching element disposed between the third and fourth signal lines, turned on and off by the inverting signal of the alternating signal.

The invention is characterized in that the liquid crystal display panel is formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels, and the driving means comprises:

scanning electrode driving means for applying a selection potential to the scanning electrodes sequentially in order of line arrangement at every predetermined horizontal scanning period within a predetermined vertical scanning period, for applying a nonselection potential to the scanning electrodes to which the selection potential is not applied, for selecting the first and sixth potentials V1, V6 supplied from the power supply means as the selection potentials, on the basis of an alternating signal for specifying a timing for inverting the polarity of voltage to be applied to the liquid crystal display panel, and for selecting the fifth and second potentials V5, V2 supplied from the power supply means as the nonselection potentials, on the basis of the alternating signal; and signal electrode driving means for selectively applying an ON or OFF potential to the signal electrodes of the liquid crystal display panel on the basis of data to be displayed at the pixels of the liquid crystal display panel, for selecting the sixth and first potentials V6, V1 supplied from the power supply means as the ON potentials, on the basis of the alternating signal, and for selecting the fourth and third potentials V4, V3 supplied from the power supply means as the OFF potentials on the basis of the alternating signal.

The invention provides a liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

scanning electrode driving means for applying either one of first and second selection potentials having an equal potential difference from a predetermined reference potential, to the scanning electrodes sequentially in order of line arrangement at every predetermined horizontal scanning period within a predetermined vertical scanning period, and for applying a nonselection potential, which is a potential opposite though the reference potential to the potential applied as the selection, to the remaining scanning electrodes to which the selection potential is not applied; and signal electrode driving means for applying an ON potential or an OFF potential, which is opposite through the reference potential to the selection potential, to the signal electrodes on the basis of data to be displayed at the pixels corresponding to the scanning electrodes to which either one of the selection potentials is applied within the horizontal scanning period;

the liquid crystal display device further comprising:

first switching means provided between the liquid crystal display panel and the scanning electrode driving means, the first switching means being provided with switching elements for turning on and off the electric connection between the scanning electrodes adjacent to each other; and control means for by providing an instruction to the scanning electrode driving means so as to isolate a scanning electrode, to which the selection potential has been applied, and a scanning electrode, to which the selection potential is to be applied next, for a predetermined period after the horizontal scanning period, and for turning on a switching element provided between the scanning electrode, to which the selection potential has been applied, and the scanning electrode, to which the selection potential is to be applied next, for the predetermined period.

The invention provides a liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

scanning electrode driving means for applying either one of first and second selection potentials having an equal potential difference from a predetermined reference potential, to the scanning electrodes sequentially in order of line arrangement at every predetermined horizontal scanning period within a predetermined vertical scanning period, and for applying a nonselection potential, which is a potential opposite through the reference potential to the potential applied as the selection potential, to the remaining scanning electrodes to which the selection potential is not applied; and signal electrode driving means for applying an ON potential or an OFF potential, which is opposite through the reference potential to the selection potential, to the signal electrodes on the basis of data to be displayed at the pixels corresponding to the scanning electrodes to which either one of the selection potentials is applied within the horizontal scanning period;

the liquid crystal display device further comprising:

second switching means provided between the liquid crystal display panel and the signal electrode driving means, the second switching means being provided with switching elements for turning on and off the electric connections between the signal electrodes adjacent to each other; and control means for providing an instruction to the signal electrode driving means so as to isolate all the signal electrodes for a predetermined period after the horizontal scanning period, and for turning on all the switching elements of the second switching means for the predetermined period.

The invention provides a liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

scanning electrode driving means supplied with first and second selection potentials V1, V6 having an equal potential difference from a predetermined reference potential and first and second nonselection potentials V5, V2 having an equal potential difference from the reference potential and a different potential from the first and second selection potentials V1, V6, for applying either one of the selection potentials to the scanning electrodes sequentially in order of line arrangement at every predetermined horizontal scanning period within a predetermined vertical scanning period, and for applying a nonselection potential, which is a potential opposite through the reference potential to the potential applied as the selection potential, to the remaining scanning electrodes to which the selection potential is not applied;

signal electrode driving means for supplied with first and second ON potentials V6, V1 having an equal potential difference from the reference potential and first and second OFF potentials V4, V3 having an equal potential difference from the reference potential and a different potential from the first and second ON potentials, for applying an ON potential or an OFF potential, which is opposite through the reference potential to the selection potential, to signal electrodes on the basis of data to be displayed at the pixels corresponding to the scanning electrodes to which either one of the selection potentials is applied within the horizontal scanning period; and power supply means for generating the six potentials V1 to V6 (V1>V2>V3>V4>V5>V6);

the liquid crystal display device further comprising:

first switching means provided between the liquid crystal display panel and the scanning electrode driving means, the first switching means being provided with switching elements for turning on and off the electric connection between the scanning electrodes adjacent to each other;

control means for by providing an instruction to the scanning electrode driving means so as to isolate a scanning electrode, to which the selection potential has been applied, and a scanning electrode, to which the selection potential is to be applied next, for a predetermined period after the horizontal scanning period, and for turning on a switching element provided between the scanning electrode, to which the selection potential has been applied, and the scanning electrode, to which the selection potential is to be applied next, for the predetermined period.

The invention provides a liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

scanning electrode driving means supplied with first and second selection potentials V1, V6 having an equal potential difference from a predetermined reference potential and first and second nonselection potentials V5, V2 having an equal potential difference from the reference potential and a different potential from the first and second selection potentials, for applying either one of the selection potentials to the scanning electrodes sequentially in order of line arrangement at every predetermined horizontal scanning period within a predetermined vertical scanning period, and for applying a nonselection potential, which is a potential opposite through the reference potential to the potential applied as the selection potential, to the remaining scanning electrodes to which the selection potential is not applied;

signal electrode driving means for supplied with first and second ON potentials V6, V1 having an equal potential difference from the reference potential and first and second OFF potentials V4, V3 having an equal potential difference from the reference potential and a different potential from the first and second ON potentials, for applying an ON potential or an OFF potential, which is opposite through the reference potential to the selection potential, to signal electrodes on the basis of data to be displayed at the pixels corresponding to the scanning electrodes to which either one of the selection potentials is applied within the horizontal scanning period; and power supply means for generating the six potentials V1 to V6 (V1>V2>V3>V4>V5>V6);

the liquid crystal display device further comprising:

second switching means provided between the liquid crystal display panel and the signal electrode driving means, the second switching means being provided with switching elements for turning on and off the electric connections between the signal electrodes adjacent to each other;

control means for providing an instruction to the signal electrode driving means so as to isolate all the signal electrodes for a predetermined period after the horizontal scanning period, and for turning on all the switching elements of the second switching means for the predetermined period.

The invention is characterized in that the liquid crystal display device comprises second switching means provided with a switching elements for turning on and off the electric connection between the signal electrodes adjacent to each other, the switching elements being disposed between the liquid crystal display panel and the signal electrode driving means, and the control means provides an instruction to the signal electrode driving means so as to isolate all the signal electrodes for a predetermined period after the horizontal scanning period, and turns on all the switching elements of the second switching means for the predetermined period.

The invention is characterized in that the power supply means includes:

five power supplies for generating a high potential Vi and low potentials Vi+1 (i=1 to 5); and a voltage level arbitration circuit for delivering potentials V1 to V6 by commonly connecting equal potentials among the potentials from the power supplies.

The invention is characterized in that the power supply means includes:

a first power supply for generating a high potential V1 and a low potential V6;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and V6.

The invention is characterized in that the power supply means includes:

a first power supply for generating a high potential V3 and a low potential V4;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and V6.

The invention is characterized in that the power supply means includes:

a first power supply for generating a high potential V1 and a low potential V4;

a second power supply for generating a high potential V1 and a low potential V3;

a third power supply for generating a high potential V4 and a low potential V6; and voltage level arbitration means for delivering the potentials V1, V3, V4 and V6 by commonly connecting equal potentials among the potentials from the first, second and third power supplies, for creating and delivering the potential V2 by dividing the difference between the potentials V1 and V3, and for creating and delivering the potential V5 by dividing the difference between the potentials V4 and V6.

The invention is characterized in that the power supply means includes:

a first power supply for generating a high potential V1 and a low potential V6;

a second power supply for generating a high potential V3 and a low potential V4; and voltage level arbitration means for creating and delivering the six potentials V1 to V6 on the basis from the potentials of the first and second power supplies, and the voltage level arbitration means includes:

a first signal line supplied with the potential V1;

a second signal line supplied with the potential V4;

a third signal line supplied with the potential V3;

a fourth signal line supplied with the potential V6;

a first switching element disposed between the first and second signal lines, turned on and off by an alternating signal for specifying a timing for inverting the polarity of the voltage to be applied to the liquid crystal display panel; and a second switching element disposed between the third and fourth signal lines, turned on and off by the inverting signal of the alternating signal.

The invention is characterized in that the respective potentials delivered from the power supply means have relationship of:

difference between V1 and V2: difference between V2 and V3: difference between V3 and V4: difference between V4 and V5: difference between V5 and V6=1:1:1:1:1.

The invention is characterized in that the respective potentials delivered from the power supply means have relationship of:

difference between V1 and V2: difference between V2 and V3: difference between V3 and V4: difference between V4 and V5: difference between V5 and V6=1:1:9:1:1.

In accordance with the invention, on the basis of the high potential V1 and the low potential V6 generated by the first power supply, the high potential V1 and the low potential V3 generated by the second power supply, and the high potential V4 and the low potential V6 generated by the third power supply, the voltage level arbitration circuit of the power supply means creates potentials V2 and V5 to deliver the potentials V1 to V6. The driving means selects at least two potentials from among the six potentials supplied from the power supply means, in accordance with an image to be displayed on the liquid crystal display panel, and drive the liquid crystal display panel. When current flows between the potential V1 and the potential V4, V5 or V6, or between the potential V4 and the potential V1, V2 or V3, the first power supply operates. When current flows between the potential V1 and the potential V3, the second power supply operates. When current flows between the potential V4 and the potential V6, the third power supply operates. Accordingly, either one of the power supplies operates in accordance with a combination of two potentials to be applied to the liquid crystal display panel. When the liquid crystal display panel is driven by the potentials delivered from the second OF third power supply, whose voltage being set lower than the voltage of the first power supply, current can be prevented from flowing between potentials supplied from other power supplies, thereby eliminating waste of power consumption.

It is preferable that, on the basis of the high potential V3 and the low potential V4 generated by the first power supply, the high potential V1 and the low potential V3 generated by the second power supply, and the high potential V4 and the low potential V6 generated by the third power supply, the power supply means delivers the potential V1 to potential V6. When current flows between the potential V1 and the potential V4, V5 or V6, or between the potential V4 and the potential V1, V2 or V3 by the driving means, the first, second and third power supplies operate. When current flows between the potentials V1 and V3 by the driving means, the second power supply operates. When current flows between the potential V4 and the potential V6 by the driving means, the third power supply operates.

Accordingly, the power supplies operate in accordance with a combination of two potentials to be applied to the liquid crystal display panel. When the liquid crystal display panel is driven by the potentials delivered from one of the second and third power supplies, current can be prevented from flowing between potentials supplied from other power supplies, thereby eliminating waste of power consumption.

In addition, it is preferable that, on the basis of the high potential V1 and the low potential V4 generated by the first power supply, the high potential V1 and the low potential V3 generated by the second power supply and the high potential V4 and the low potential V6 generated by the third power supply, the power supply means delivers the potentials V1 to V6. When current flows between the potential V1 and the potential V4, V5 or V6, or between the potential V4 and the potential V1, V2 or V3 by the driving means, the first and second power supplies operate. When current flows between the potential V1 and the potential V3 by the driving means, the second power supply operates. When current flows between the potential V4 and the potential V6 by the driving means, the third power supply operates. Accordingly, the power supplies operate in accordance with a combination of two potentials to be applied to the liquid crystal display panel. When the liquid crystal display panel is driven by the potentials delivered from one of the second and third power supplies, current can be prevented from flowing between potentials supplied from other power supplies, thereby eliminating waste of power consumption.

In accordance with the invention, the driving means inverts two of the six potentials supplied from the power supply means, with respect to the reference potential on the basis of the signal for specifying an alternating period, and applies the inverted potentials to the liquid crystal display panel. The first and second power supplies of the power supply means supply the generated potentials V1, V3, V4 and V6 to the first to fourth signal lines of the voltage level arbitration circuit. In the voltage level arbitration circuit, when the first switching element disposed between the first and second signal lines is turned on by the alternating signal, the potential at the second signal line becomes equal to the potential at the first signal line and the potential V1 is delivered. When the potential at the second signal line becomes the potential V1, the difference between the potential V1 at the second signal line and the potential V3 at the third signal line is divided and the potential V2 is delivered. When the second switching element disposed between the third and fourth signal lines is turned on by the alternating signal, the potential at the third signal line becomes equal to the potential at the fourth signal line and the potential V6 is delivered. When the potential at the third signal line becomes the potential V6, the difference between the potential V4 at the second signal line and the potential V6 at the third signal line is divided and the potential V5 is delivered. Accordingly, regardless of any combinations of two potentials selected at every alternating period determined by the alternating signal, current can be made to flow between the two potentials while current is prevented from flowing between other potentials, thereby reducing the waste of power consumption.

In accordance with the invention, the liquid crystal display panel performs displaying when voltages are applied to the scanning electrodes and the signal electrodes by the scanning electrode driving means and the signal electrode driving means. The scanning electrode driving means is supplied with the first, second, fifth and sixth potentials from the power supply means. For the combination of potentials at every alternate period, when the first potential is selected as the selection potential, the scanning electrode driving means selects the fifth potential as the nonselection potential, and when the sixth potential is selected as the selection potential, the scanning electrode driving means selects the second potential as the nonselection potential. Furthermore, for the combination of potentials at every alternating period, when the first potential is selected as the selection potential, the signal electrode driving means selects the sixth potential as the ON potential and the fourth potential as the OFF potential, and when the sixth potential is selected as the selection potential, the signal electrode driving means selects the first potential as the ON potential and the third potential as the OFF potential. Accordingly, the potentials to be applied to the liquid crystal display panel are switched at every alternating period determined by the alternating signal, and the panel can be driven alternately. Moreover, regardless of any combinations of two selected potentials, current can be made to flow between the two potentials while current can be prevented from flowing between other potentials, thereby reducing the waste of power consumption.

In accordance with the invention, the liquid crystal display device is provided with the first switching means between the scanning electrodes of the liquid crystal display panel and the scanning electrode driving means. The first switch means is equipped with switching elements turning on/off the electric connection between the scanning electrodes adjacent to each other. The control means isolates a scanning electrode, to which the selection potential has been applied, and a scanning electrode, to which the selection potential is to be applied next, from the scanning electrode driving means, and turns on the switching element disposed between the two scanning electrodes, for a predetermined period after the completion of the horizontal scanning period. Accordingly, part of the charges remaining in the scanning electrode, to which the selection potential has been applied, are transmitted to the scanning electrode, to which the selection potential is to be applied next, for the predetermined period after the completion of the horizontal scanning period, and the potential at the scanning electrode changes to an intermediate potential between the selection and nonselection potentials, therby reducing the waste of charges and power to be supplied from the scanning electrode driving means.

In accordance with the invention, the liquid crystal display device is provided with the second switching means between the signal electrodes of the liquid crystal display panel and the signal electrode driving means, and the seconding switching means is equipped with switching elements turning on/off the electric connection between the signal electrodes adjacent to each other. The control means isolates all the signal electrodes from the signal electrode driving means, and turns on all the switching elements of the second switching means, for the predetermined period. Accordingly, all the signal electrodes are turned on by the switching elements and the charges at all the signal electrodes are averaged for the predetermined period after the completion of the horizontal scanning period, therby reducing the waste of charges and power to be supplied from the signal electrode driving means.

In accordance with the invention, the liquid crystal display device is provided with the first switching means. Furthermore, the liquid crystal display device is provided with the second switching means between the signal electrodes of the liquid crystal display panel and the signal electrode driving means, and the second switching means is equipped with switching elements for turning on/off the electric connection between the signal electrodes adjacent to each other. The control means isolates a scanning electrode, to which the selection potential has been applied, and a scanning electrode, to which the selection potential is to be applied next, from the scanning electrode driving means, and turns on the switching element disposed between the two scanning electrodes, for a predetermined period after the completion of the horizontal scanning period. In addition, all the signal electrodes are isolated from the signal electrode driving means, and all the switching elements of the second switching means are turned on, for the predetermined period. Accordingly, part of the charges remaining in the scanning electrode, to which the selection potential has been applied, are transmitted to the scanning electrode, to which the selection potential is to be applied next for the predetermined period after the completion of the horizontal scanning period, and the potential at the scanning electrode changes to an intermediate potential between the selection and nonselection potentials, thereby reducing the waste of charges and power to be supplied from the scanning electrode driving means.

Besides, all the signal electrodes are turned on by the switching elements and the charges at all the signal electrodes are averaged for the predetermined period, thereby reducing the waste of charges and power to be supplied from the scanning electrode driving means.

In accordance with the invention, the scanning electrode driving means and the signal electrode driving means select at least two predetermined potentials from six potentials V1 to V6 delivered from the power supply means, on the basis of data to be displayed on the liquid crystal display panel, and apply voltages to the liquid crystal display panel. The liquid crystal display device is provided with the first switching means between the scanning electrodes of the liquid crystal display panel and the scanning electrode driving means, the first switch means is equipped with switching elements for turning on/off the electric connection between the scanning electrodes adjacent to each other. The control means isolates a scanning electrode, to which the selection potential has been applied, and a scanning electrodes, to which the selection potential is to be applied next, from the scanning electrode driving means, and the turns on switching element disposed between the two scanning electrodes, for a predetermined period after the completion of the horizontal scanning period. Accordingly, part of the charges remaining in the scanning electrode, to which the selection potential has been applied, are transmitted to the scanning electrode, to which the selection potential is to be applied next, for the predetermined period after the completion of the horizontal scanning period, and the potential at the scanning electrode changes to an intermediate potential between the selection and nonselection potentials, thereby reducing the waste of charges and power to be supplied from the scanning electrode driving means. Moreover, regardless of any combination of two selected potentials, only the power supplies required for supplying two potentials can be operated while current is prevented from flowing from power supplies for supplying other potentials, thereby reducing the waste of power consumption.

In accordance with the invention, the six potentials delivered from the power supply means are determined so as to have equal increments. Therefore, the liquid crystal display panel can be driven at a ⅕ bias.

In accordance with the invention, the six potentials delivered from the power supply means are determined so as to have ratios of increments of 1:1:9:1:1. Therefore, the liquid crystal display panel can be driven at a 1/13 bias.

In accordance with the invention, the potentials applied to the liquid crystal display panel are potentials selected from among potentials V1 to Vn created by the voltage level arbitration circuit on the basis of the high potentials Vi and the low potentials Vi+1 generated by n−1 pieces of power supplies. Therefore, regardless of any combination of two selected potentials, current can be made to flow between the two potentials while current is prevented from flowing between other potentials. Thereby, when the liquid crystal display panel is driven, the waste of power consumption can be reduced.

In accordance with the invention, on the basis of potentials V1, V3, V4 and V6 generated as the high and low potentials of the first to third power supplies of the power supplying means, the voltage level arbitration circuit creates potentials V2 and V5, so that potentials V1 to V6 are applied to the liquid crystal display panel by the driving means. Therefore, a power supply capable of delivering potentials corresponding to the combination of two potentials selected by the driving means operates. Accordingly, when the liquid crystal display panel is driven by potentials from a power supply whose voltage is set lower, current is prevented from flowing between potentials supplied from other power supplies, thereby reducing the waste of power consumption.

In accordance with the invention, a power supply capable of delivering potentials corresponding to the combination of two potentials selected by the driving means from among potentials V1 to V6 generated from the power supply means operates at every alternating period determined by the alternating signal. Accordingly, when the liquid crystal display panel is driven by potentials from a power supply whose voltage is set lower, current is prevented from flowing between potentials supplied from other power supplies, thereby reducing the waste of power consumption.

Furthermore, in accordance with the invention, a switching element disposed between a scanning electrode, to which the selection potential has been applied, and a scanning electrode, to which the selection potential is to be applied next, is turned on for a predetermined period after the completion of the horizontal scanning period by the control means. Therefore, part of the charges remaining in the scanning electrode, to which the selection potential has been applied, can be transmitted to the scanning electrode, to which the selection potential is to be applied next, thereby reducing the waste of charges and power consumption of the liquid crystal display device device. Moreover, since the potential at each scanning electrode turned on by the switching element is transitioned steeply up to an intermediate potential, the response speed of liquid crystals is made higher, thereby enhancing the quality of display on the liquid crystal display panel.

Furthermore, in accordance with the invention, the switching elements disposed between the signal electrodes and the signal electrode driving means are turned on for a predetermined period after the completion of the horizontal scanning period by the control means. Therefore, the charges at all the signal electrodes are averaged, thereby reducing the waste of charges and power cansumptiuon of the liquid crystal display device. Moreover, since the potential at each signal electrode is transitioned steeply up to the average potential, the response speed of liquid crystals is made higher, thereby enhancing the quality of display on the liquid crystal display panel.

Furthermore, in accordance with the invention, a switching element disposed between a scanning electrode, to which the selection potential has been applied, and a scanning electrode, to which the selection potential is to be applied next, is turned on by the control means, and the switching elements disposed between the signal electrodes and the signal electrode driving means are turned on by the control means, for a predetermined period after the completion of the horizontal scanning period. Therefore, part of the charges remaining in the scanning electrode, to which the selection potential has been applied, can be transmitted to the scanning electrode, to which the selection potential is to be applied next, and the charges at all the signal electrodes are averaged, thereby reducing the waste of charges and power consumption of the liquid crystal display device. Moreover, since the potentials at the scanning and signal electrodes are transitioned steeply up to average potentials between the connected electrodes, the response speed of liquid crystals is made higher, thereby enhancing the quality of display on the liquid crystal display panel.

In accordance with the invention, the six potentials delivered from the power supply means are determined so as to have relationship of difference between V1 and V2: difference between V2 and V3: difference between V3 and V4: difference between V4 and V5: difference between V5 and V6=1:1:1:1:1. Therefore, the liquid crystal display panel can be driven at a ⅕ bias.

In accordance with the invention, the six potentials delivered from the power supply means are determined so as to have relationship of difference between V1 and V2: difference between V2 and V3: difference between V3 and V4: difference between V4 and V5: difference between V5 and V6=1:1:9:1:1. Therefore, the liquid crystal display panel can be driven at a 1/13 bias.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
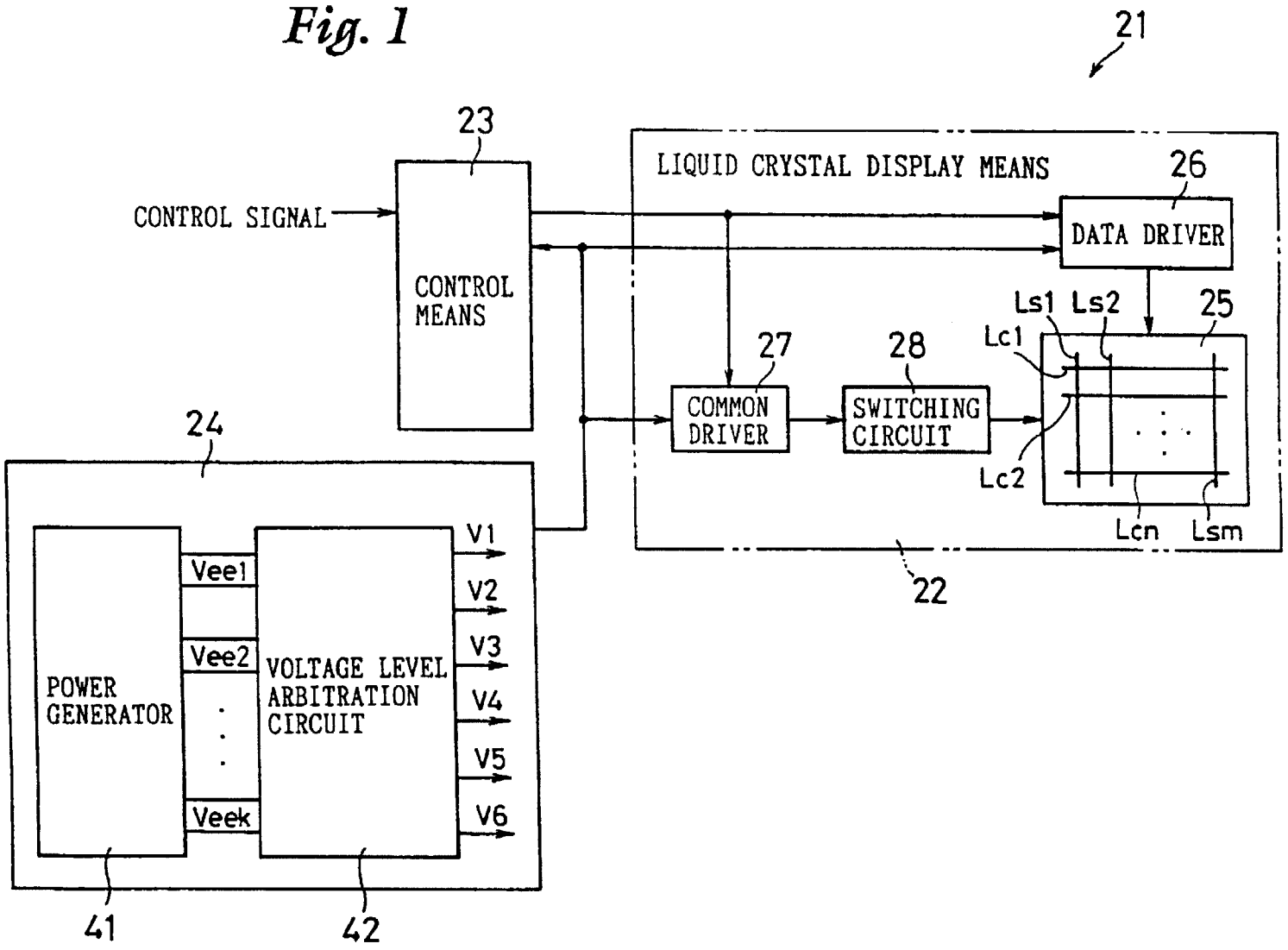
FIG. 1 is a block diagram showing a structure of a liquid crystal display device 21 in accordance with a first embodiment of the present invention.
Figure 2:
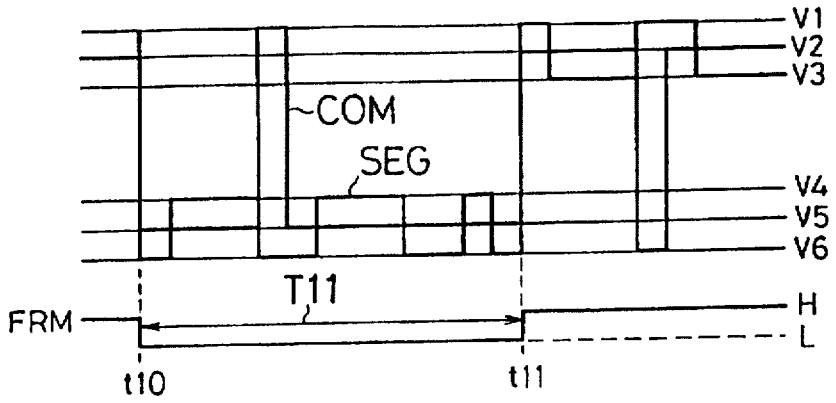
FIG. 2 is a diagram showing time division liquid crystal driving waveforms.
Figure 3:
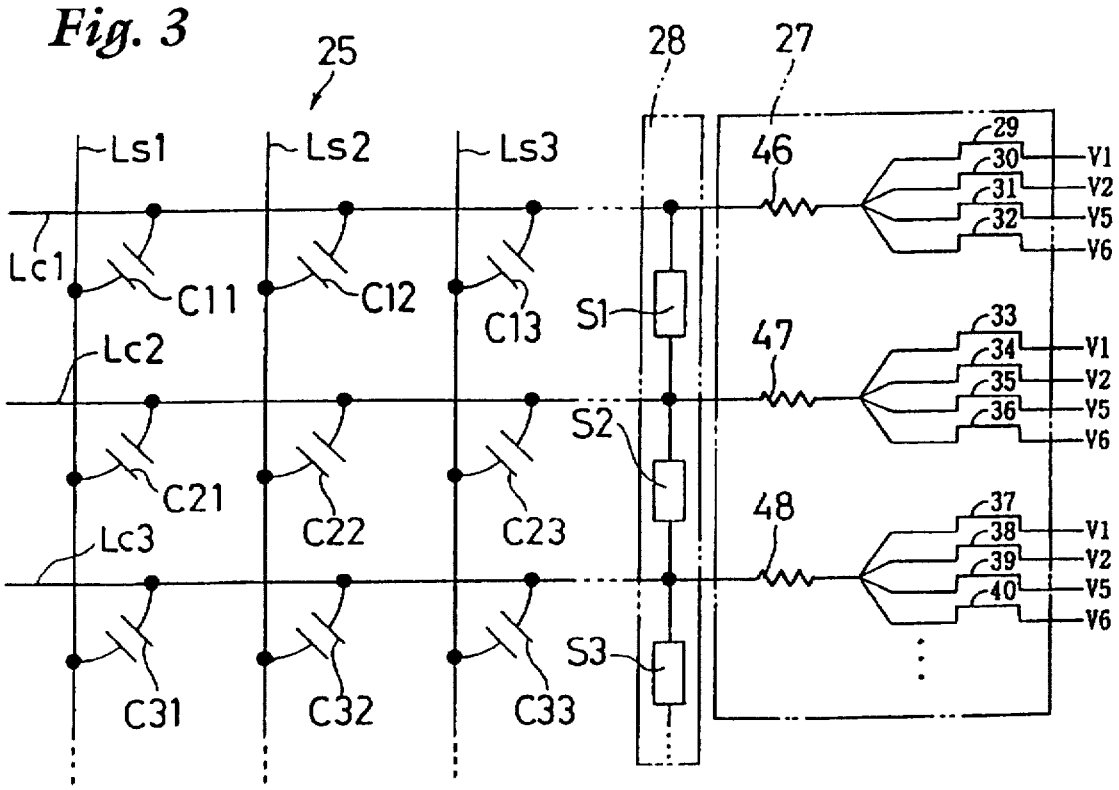
FIG. 3 is a circuit diagram around a liquid crystal display panel 25.

FIG. 1 is a block diagram showing a structure of a liquid crystal display device 21 in accordance with a first embodiment of the present invention; FIG. 2 is a diagram showing waveforms of potentials applied to electrodes Lc, Ls of a liquid crystal display panel 25; and FIG. 3 is a circuit diagram around the liquid crystal display panel 25. The liquid crystal display device 21 comprises liquid crystal display means 22, control means 23 and a power circuit 24. Furthermore, the liquid crystal display means 22 comprises the liquid crystal display panel 25, a data driver 26, a common driver 27 and a switching circuit 28.

The control means 23 controls the data driver 26 and the common driver 27 on the basis of control signals supplied externally.

The power circuit 24 comprises a power generator 41 and a voltage level arbitration circuit 42. The power generator 41 comprises a plurality of electrically isolated power supply units (k pieces of power supply units, k: an integer of 2 or more), such as batteries, DC/DC converters or the like, and each power supply unit delivers a pair of potentials (Vee1, Vee2, . . . , Veek). The voltage level arbitration circuit 42 delivers potentials V1 to V6 on the basis of the plural potentials, Vee1 to Veek, supplied from the power generator 41. The power circuit 24 supplies potentials V1, V6, that is, second and first selection potentials to be applied to scanning electrodes Lc described later, and first and second ON potentials to be applied to signal electrodes Ls described later, potentials V2, V5, that is, first and second nonselection potentials to be applied to the scanning electrodes Lc, and potentials V3, V4, that is, first and second OFF potentials to be applied to the signal electrodes Ls, to the driver 26, 27, also supplies power for driving the control means 23. These potentials are supplied to the drivers 26, 27 in accordance with the combination shown in Table 1 below.

TABLE 1

| | Scanning electrode | | Signal electrode | |
|---|---|---|---|---|
| | Selection potential | Nonselection potential | ON potential | OFF potential |
| (1) | V6 | V2 | V1 | V3 |
| (2) | V1 | V5 | V6 | V4 |

In the following description, although only the combination shown in (1) of Table 1 is used, the combination shown in (2) can also be used in the similar way. In this embodiment, the combination of potentials to be applied is changed at every vertical scanning period. In other words, in case a selection potential to be applied to the scanning electrodes sequentially in order of line arrangement during a vertical scanning period is the potential V6, the potential V2 is applied, as a nonselection potential, to other scanning electrodes to which the selection potential is not applied. During the vertical scanning period, the potential V1 is applied as an ON potential and a potential V3 is applied as an OFF potential, to the signal electrodes. During the following vertical scanning period, the potential V1 is applied as a selection potential and the potential V5 is applied as a nonselection potential, to the scanning electrodes. To the signal electrodes, the potential V6 is applied as an ON potential and the potential V4 is applied as an OFF potential.

Referring to FIG. 2, the waveform of a potential to be applied to the scanning electrodes Lc is shown as signal COM in FIG. 2(1), the waveform of a potential to be applied to the signal electrodes Ls is shown as signal SEG in FIG. 2(2). A signal FRM shown in FIG. 2(3) determines the timing for switching the combination of (1) and (2) shown in Table 1 above. During a vertical scanning period T11 from time t10 to time t11, the signal FRM is low, and the selection and nonselection potentials of the signal COM are the potentials V1 and V5, respectively, and the ON and OFF potentials of the signal SEG are the potentials V6 and V4, respectively.

During the next vertical scanning period from time t11, the signal FRM is high, and the selection and nonselection potentials of the signal COM are potentials V6 and V2, respectively, and the ON and OFF potentials of the signal SEG are the potentials V1 and V3 respectively.

The liquid crystal display panel 25 is made by interposing a liquid crystal layer between a pair of substrate members. In one of the pair of substrate members, a plurality of scanning electrodes Lc1, Lc2, . . . , Lcn (generally referred to as Lc) are arranged on one surface of a transparent substrate made of glass, plastic or the like, and the entire surface on which the scanning electrodes Lc are arranged is covered with an orientation film. Furthermore, in the other substrate member, a plurality of signal electrodes Ls1, Ls2, . . . , Lsm (generally referred to as Ls) are arranged on one surface of a transparent substrate made of glass, plastic or the like, and the entire surface on which the signal electrodes Ls are arranged is covered with an orientation film. The pair of substrate members are aligned so that the orientation films face each other and so that the signal electrodes Ls intersect the scanning electrodes Lc, and the pair of substrate members are attached to each other with a predetermined clearance by a sealing member, and liquid crystals are disposed between the substrate members to form the liquid crystal layer. As shown in FIG. 2, the intersection portions of the scanning electrodes Lc and the signal electrodes Ls are used as pixels on the liquid crystal display panel 25 and indicated as electrically equivalent capacitors C11, C12, . . . , C33, . . . including electrodes (the pixels generally referred to as C).

As shown in FIG. 3, the common driver 27 comprises a protective resistor and a plurality of driving transistors for each scanning electrode Lc in the liquid crystal display panel 25. In the common driver 27, the potentials V1, V2, V5 and V6 supplied from the power circuit 24 are supplied to corresponding driving transistors 29 to 40. In accordance with a signal supplied from the control means 23, a predetermined driving transistor is turned on, and a potential corresponding to the driving transistor is supplied to each scanning electrode Lc via a protective resistor. For the scanning electrode Lc1, the driving transistors 29 to 32 and a protective resistor 46 are provided, for the scanning electrode Lc2, the driving transistors 33 to 36 and a protective resistor 47 are provided, and for the scanning electrode Lc3, driving transistors 37 to 40 and a protective resistor 48 are provided. For each of other scanning electrodes Lc, four driving transistors and one protective resistor are provided.

The switching circuit 28 is provided between the scanning electrodes Lc and the common driver 27, and includes switches S1, S2, S3, . . . (generally referred to as S). In the switching circuit 28, the switch S1 is provided between the scanning electrode Lc1 and the scanning electrode Lc2, and the switch S2 is provided between the scanning electrode Lc2 and the scanning electrode Lc3. In other words, the switch S is provided between two scanning electrodes Lc adjacent to each other. Therefore, n−1 number of switches S are provided in the switching circuit 28. By virtue of the switches S, the adjacent scanning electrodes Lc can be conducted electrically. Charges can thus be transferred between the two adjacent scanning electrodes. The switches S in the switching circuit 28 are controlled by the control means 23 so as to operate at predetermined timing.

Figures 4A, 4B:
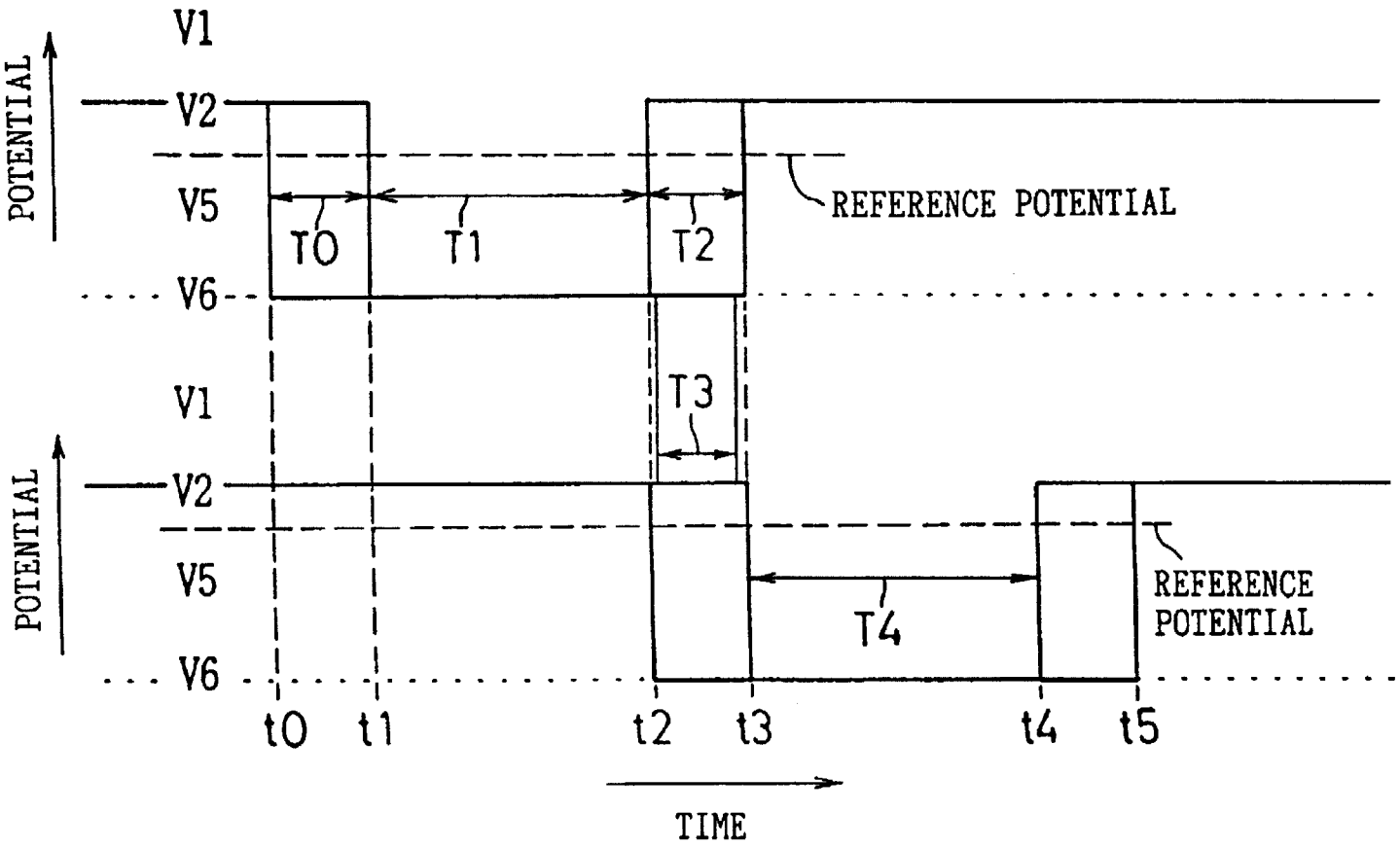
FIGS. 4A and 4B are a timing chart showing waveforms of potentials to be applied to scanning electrodes Lc2, Lc3.

FIGS. 4A, 4B are timing charts showing waveforms of potentials to be applied to the scanning electrodes Lc2, Lc3, respectively. The timing charts shown in FIG. 4 are explained in accordance with the combination shown in Table 1 (1). FIG. 4A shows the waveform of a potential to be applied to the scanning electrode Lc2, and FIG. 4B shows the waveform of a potential to be applied to the scanning electrode Lc3.

In the potential waveform shown in FIG. 4A, the potential V2, a nonselection potential, is applied to the scanning electrode Lc2 until time t0, and the scanning electrode Lc2 is not selected. In the common driver 27 shown in FIG. 3, the transistor 34 is on. When the transistor 34 is turned off at the time t0 and none of the transistors 33 to 36 is turned on during a period T0 from the time t0 to time t1, no potential is applied to the scanning electrode Lc2. When the transistor 36 is turned on at the time t1, the potential V6, a selection potential, is applied to the scanning electrode Lc2. During a period T1 from the time t1 to time t2, the scanning electrode Lc2 is selected. The potentials V2 and V6 have reverse polarities to each other with a reference potential. When the transistor 36 is turned off at the time t2 and none of the transistors 33 to 36 is turned on during a period T2 from time t2 to time t3, no potential is applied to the scanning electrode Lc2. When the transistor 38 is turned off at the time t2 as shown in FIG. 4B, the potential V2, a nonselection potential, is not applied to the scanning electrode Lc3. When none of the transistors 37 to 40 is turned on during the period T2, no potential is applied to the scanning electrode Lc3. During a period T3, which is shorter than the period T2, the switch S2 in the switching circuit 28 is turned on, and the scanning electrodes Lc2 and Lc3 are conductive with each other, and part of the charges stored in liquid crystal segments of the scanning electrode Lc2 moves to the scanning electrode Lc3. When the transistor 34 is turned on at the time t3, the potential V2 is applied to the scanning electrode Lc2 and the electrode is not selected during this period. FIG. 4B shows the waveform of a potential to be applied to the scanning electrode Lc3. This potential is equal to a potential V6 since the transistor 40 is turned on during period T4 from time t3 to t4. The scanning electrode Lc3 is thus selected during this period.

One vertical scanning period is completed when the operation similar to that described above is performed for all the scanning electrodes Lc. Each scanning electrode is selected only once in one vertical scanning period. In the liquid crystal display device 21, the similar operation is repeated to perform displaying.

As described above, in accordance with the present embodiment, the switching circuit 28 is provided between the common driver 27 and the scanning electrodes Lc. When a selection potential is applied to each scanning electrode Lc, a period during which none of potentials is applied is set between the nonselection period and the selection period. During the potential nonapplication period, a scanning electrode for which selection has ended and a scanning electrode which is to be selected next are made conductive write to each other by turning on the switch S. Therefore, after the completion of the selection period, part of the charges stored in the liquid crystal segments can be transferred to the scanning electrode to be selected next. Waste of charges can thus be reduced. Furthermore, since the potential at a scanning electrode having been conducted is changed to an intermediate potential and the transition up to the intermediate potential is not affected by the driver circuit and the protective resistors, the transition is steep and the response speed of the liquid crystals is improved, thereby enhancing the quality of display on the liquid crystal display panel 25.

Figure 5:
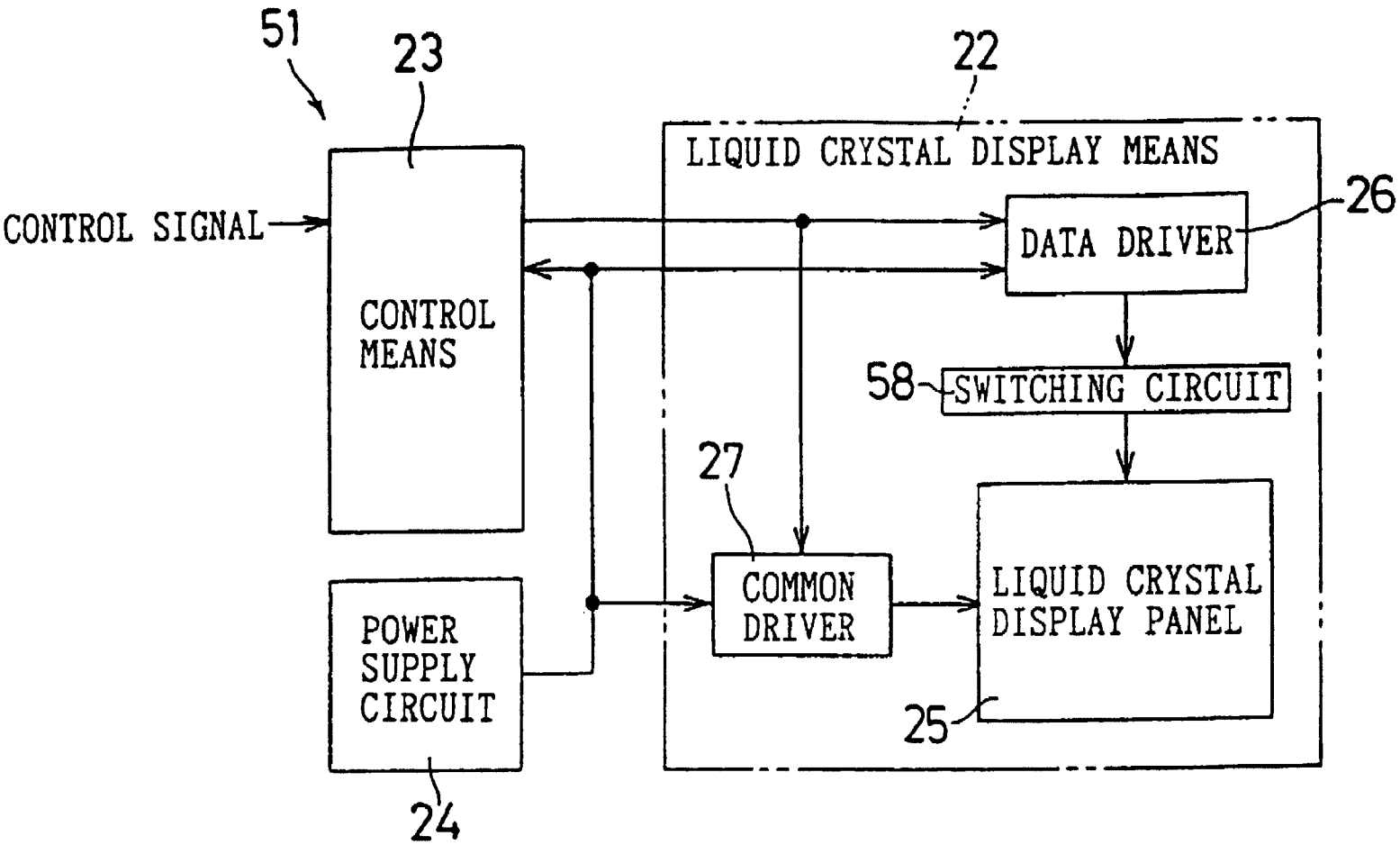
FIG. 5 is a block diagram showing a structure of a liquid crystal display device 51 in accordance with a second embodiment of the invention.
Figure 6:
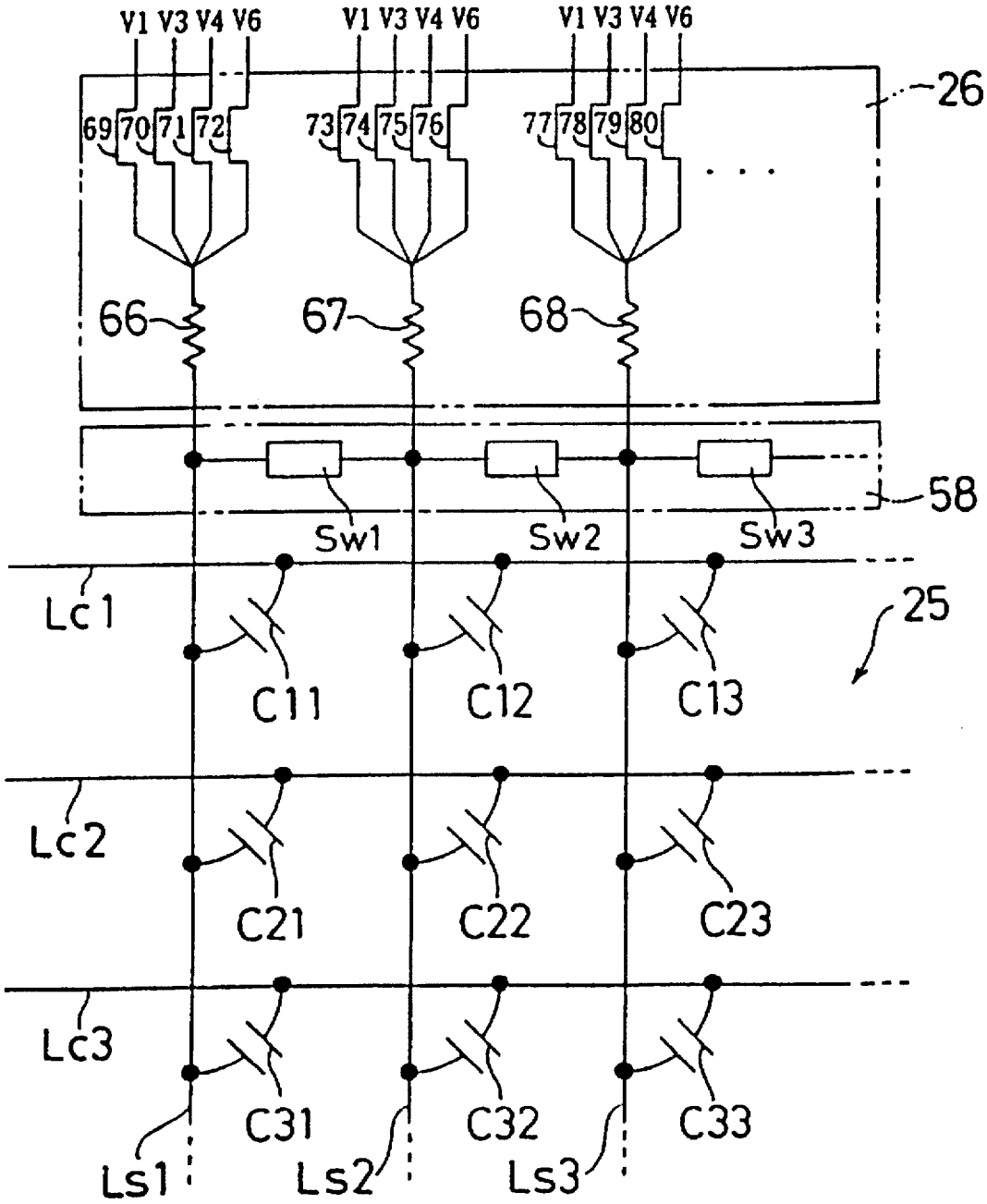
FIG. 6 is a circuit diagram around a liquid crystal display panel 25.

FIG. 5 is a block diagram showing a structure of a liquid crystal display device 51 in accordance with a second embodiment of the invention, and FIG. 6 is a circuit diagram around a liquid crystal display panel 25. In the liquid crystal display device 51, the same reference numerals designate the same components as those used in the liquid crystal display device 21 in accordance with the first embodiment, and such components are not described here. The liquid crystal display device 51 is characterized in that a switching circuit 58 is provided between the data driver 26 and the liquid crystal display panel 25, instead of the switching circuit 28 provided between the common driver 27 and the liquid crystal display panel 25 of the liquid crystal display 21. In the data driver 26 shown in detail in FIG. 6, m (an integer) groups of four driving transistors and a protective resistor to be controlled by the control means 23 are provided so as to correspond to the signal electrodes Ls. The potentials V1, V3, V4 and V6 supplied from the power circuit 24 can be selectively applied to the signal electrode Ls. As shown in FIG. 6, for the signal electrode Ls1, driving transistors 69 to 72 and a protective resistor 66 are provided, for the signal electrode Ls2, driving transistors 73 to 76 and a protective resistor 67 are provided.

The switching circuit 58 comprises m−1 number of switches Sw. A switch Sw1 is provided between the signal electrodes Ls1 and Ls2, a switch Sw2 is provided between the signal electrodes Ls2 and Ls3, and a switch Sw3 is provided between the signal electrodes Ls3 and Ls4.

In the embodiment, for example, when selection is switched from the scanning electrode Lc2 to the scanning electrode Lc3, all the transistors 69 to 80 included in the data driver 26 are turned off so as to isolate the signal electrode Ls from the data driver 26, all the switches Sw are turned on so as to average charges at the signal electrodes Ls, and then the switches Sw are turned off after the charges are moved. After the scanning electrode Lc3 is selected, the predetermined driving transistors 69 to 80 in the data driver 26 are selectively conducted conductives so as to apply potentials corresponding to data to be displayed to the signal electrodes Ls. After this, in the same way as described above, when the scanning electrodes Lc are selected sequentially in order of line arrangement, the above-mentioned operation is repeated so as to average the charges remaining in the liquid crystal elements at each signal electrode Ls.

Referring to FIG. 4 described before, during the period T2 between the period T1 in which the scanning electrode Lc2 is selected and the period T4 in which the scanning electrode Lc3 is selected, the signal electrodes Ls are isolated from the data driver 26. Furthermore, during the period T3, all the signal electrodes Ls are conducted to one another so as to average the potentials at all the signal electrodes Ls. After this, the same operation is repeated during each horizontal scanning period.

As described above, in accordance with the embodiment, the switching circuit 58 is provided between the data driver 26 and the signal electrode Ls, and a period in which no potential is applied to the signal electrodes Ls is set between the selection period of a scanning electrode and the selection period of the next scanning electrode. Since all the signal electrodes Ls are conducted by turning on all the switches Sw during the potential nonapplication period, the charges remaining in the liquid crystal elements after the selection period can be averaged at all the signal electrodes Ls and the waste of charges can be reduced. In addition, since the potentials of all the signal electrodes Ls are averaged and the transition at the time of averaging is not affected by the driver circuit and the protective resistors, the transition can be made steep, the response speed of the liquid crystals can be improved, thereby enhancing the quality of display on the liquid crystal display panel 25.

Moreover, in the embodiments described above, although the switching circuit 28 and the switching circuit 58 are provided independently, both the switching circuit 28 and the switching circuit 58 can be provided for each embodiment. This structure can reduce more power consumption than a structure provided with one of the two switching circuits.

Figure 7:
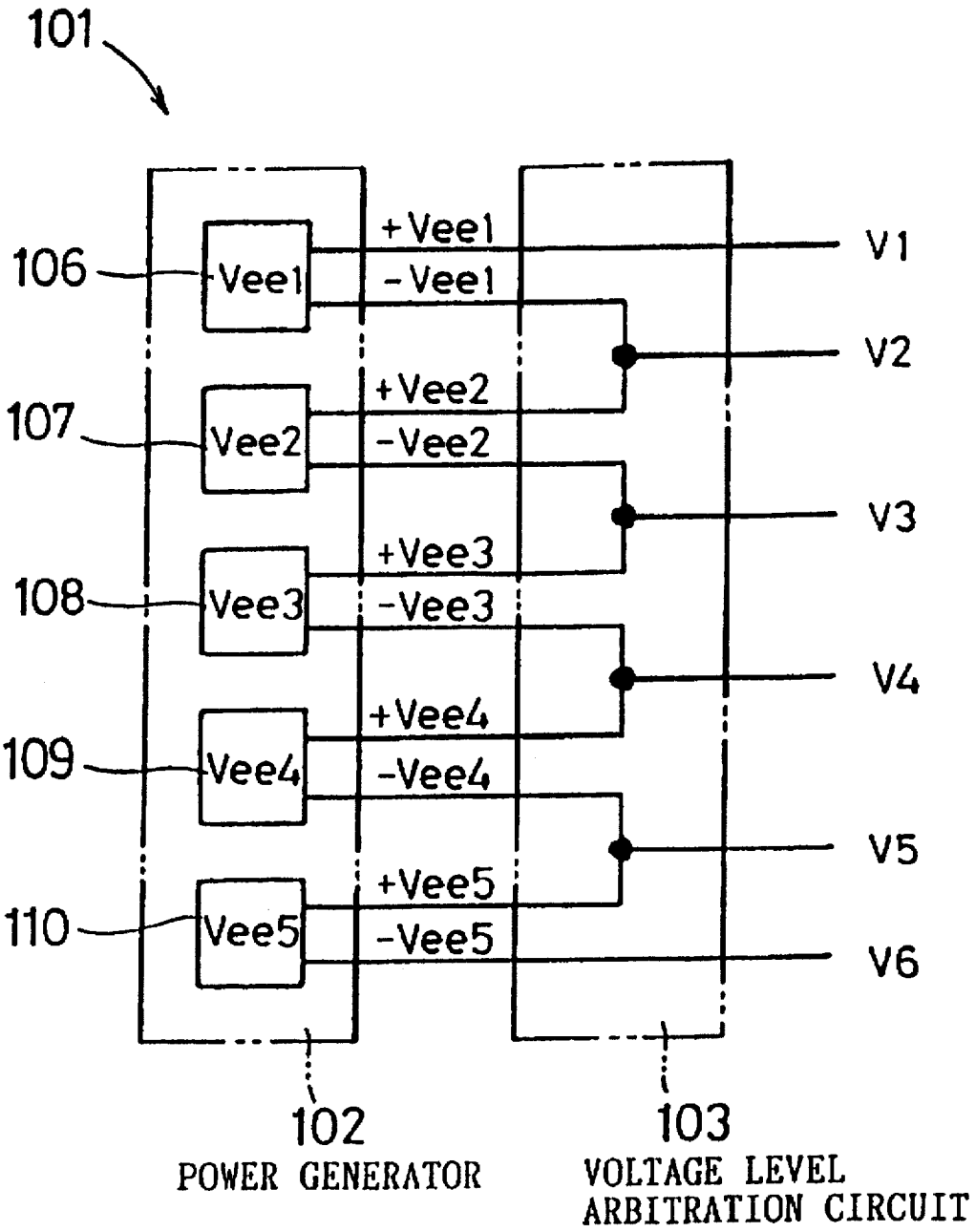
FIG. 7 is a circuit diagram of a power circuit 101 in accordance with a third embodiment of the invention.

FIG. 7 is a digram illustrating a power circuit 101 in accordance with a third embodiment of the invention. In this embodiment, an example of a circuit which generates six potentials from five power supplies is illustrated. The power circuit 101 comprises a voltage generator 102 and a voltage level arbitration circuit 103. The voltage generator 102 comprises five electrically isolated power supplies 106 to 110 so as to deliver potentials Vee1 to Vee5, respectively. Furthermore, each power supply delivers a high potential (+Vee) and a low potential (−Vee). In the voltage level arbitration circuit 103, as shown in FIG. 7, pairs of potentials, −Vee1 and +Vee2, −Vee2 and +Vee3, −Vee3 and +Vee4, and −Vee4 and +Vee5 are connected to each other, potentials in each pair having an identical potential. The potentials delivered from the power supplies 106 to 110 have relationships represented by +Vee1>+Vee2>+Vee3>+Vee4>+Vee5>−Vee5, and these are delivered as potentials V1, V2, V3, V4, V5 and V6, respectively. When all the voltages (each voltage: a difference between +potential and −potential) of the power supplies 106 to 110 are equal, the liquid crystal display device operates as a 1/5 bias display, and when the voltages have ratios of 1:1:9:1:1, the liquid crystal display device operates as a 1/13 bias display.

With the power circuit 101 in accordance with the third embodiment of the invention, when current flows between any two potentials of Vee1 to Vee5, no current flows between any other potentials. Therefore, power loss can be reduced.

When current flows between the potentials V1 and V6, for example, the power supplies 106 to 110 delivering Vee1 to Vee5 and operate as one power supply connected in series. However, when current flows between the potentials V2 and V3, since the power supply 107 delivering Vee2 operates as one power supply, no current flows between other potentials. Accordingly, in this case, power consumption conventionally caused due to the potential differences between V1 and V2 and between V3 and V6 can be reduced to zero.

Figure 8:
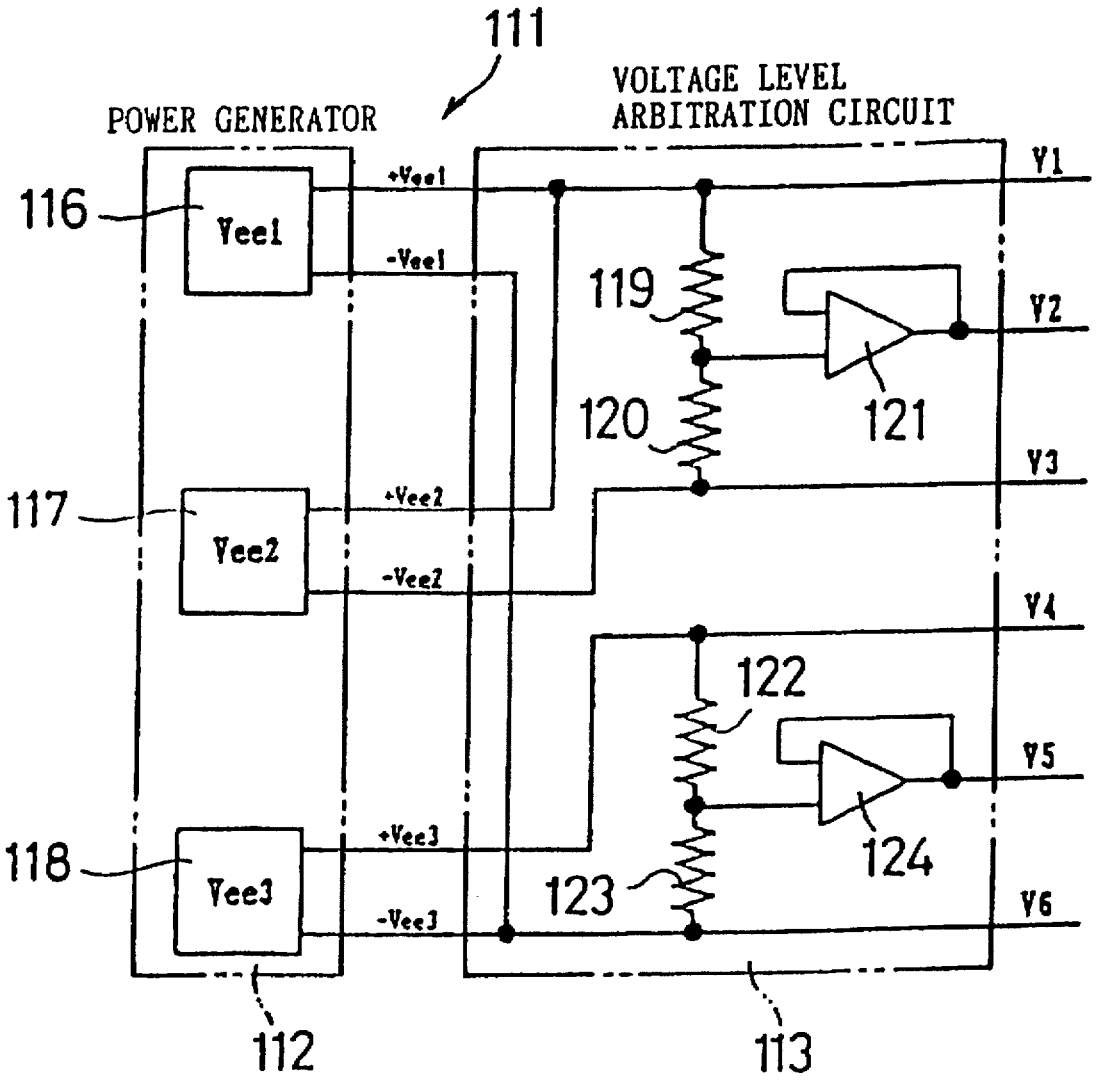
FIG. 8 is a circuit diagram of a power circuit in accordance with a fourth embodiment of the invention.

FIG. 8 is a block diagram illustrating a power circuit 111 in accordance with a fourth embodiment of the invention. In this embodiment, a power generator 112 has first, second and third power supplies 116 to 118. In a voltage level arbitration circuit 113, a high potential +Vee1 of the first power supply 116 is connected to high potential +Vee2 of the second power supply 117, and a low potential −Vee1 of the first power supply 116 is connected to a low potential −Vee3 of the third power supply 118 to generate potentials required for driving the liquid crystal display panel 25.

Referring to FIG. 8, the power supplies 116 to 118 for delivering potentials Vee1, Vee2 and Vee3 are electrically isolated power supplies, such as dry cells and DC/DC converters. The relationship of the voltages (each voltage: a difference between +potential and −potential) of the power supplies 116 to 118 is Vee1>Vee2=Vee3. In the voltage level arbitration circuit 113, +Vee1 and +Vee2 having an identical potential are connected to each other, and −Vee1 and −Vee3 having an identical potential are also connected to each other. The potentials delivered from the power supplies 118 to 118 have relationships of +Vee1=Vee2>−Vee2>+Vee3>−

Vee3=−Vee1, and the potentials are delivered as potentials V1, V3, V4 and V6, respectively.

The difference between the potentials V1 and V3 is divided by resistors 119 and 120 to obtain an intermediate potential between the two potentials, and the intermediate potential is current-amplified by an operational amplifier 121 and delivered as a potential V2. Furthermore, the difference between the potentials V4 and V6 is divided by resistors 122 and 123 to obtain an intermediate potential between the two potentials, and the intermediate potential is current-amplified by an operational amplifier 124 and delivered as potential V5.

In the power circuit 111, when current flows between the potentials V1 and V3, the power supply 117 operates as a power supply, and power to be consumed amounts to current value×(difference between the potentials V1 and V3). When current flows between the potentials V4 and V6, the power supply 118 operates as a power supply, and power to be consumed amounts to current value×(difference between the potentials V4 and V6). When current flows between the potentials V1 and V4, V5 or V5, or when current flows between the potentials V1, V2 or V3 and V6, the power supply 116 operates as a power supply.

As described above, in accordance with the fourth embodiment of the invention, when current flows between the potentials V1 and V3, the power supply 117 for delivering a voltage lower than that of the power supply 116 operates as a power supply. Therefore, power consumption due to the potential difference between the potentials V4 and V6 having been consumed wastefully by the conventional power circuit can be eliminated. In the same way, when current flows between the potentials V4 and V6, the power supply 118 for delivering a voltage lower than that of the power supply 116 operates as a power supply. Therefore, power consumption due to the potential difference between the potentials V1 and V3 having been consumed wastefully can be eliminated.

Figure 9:
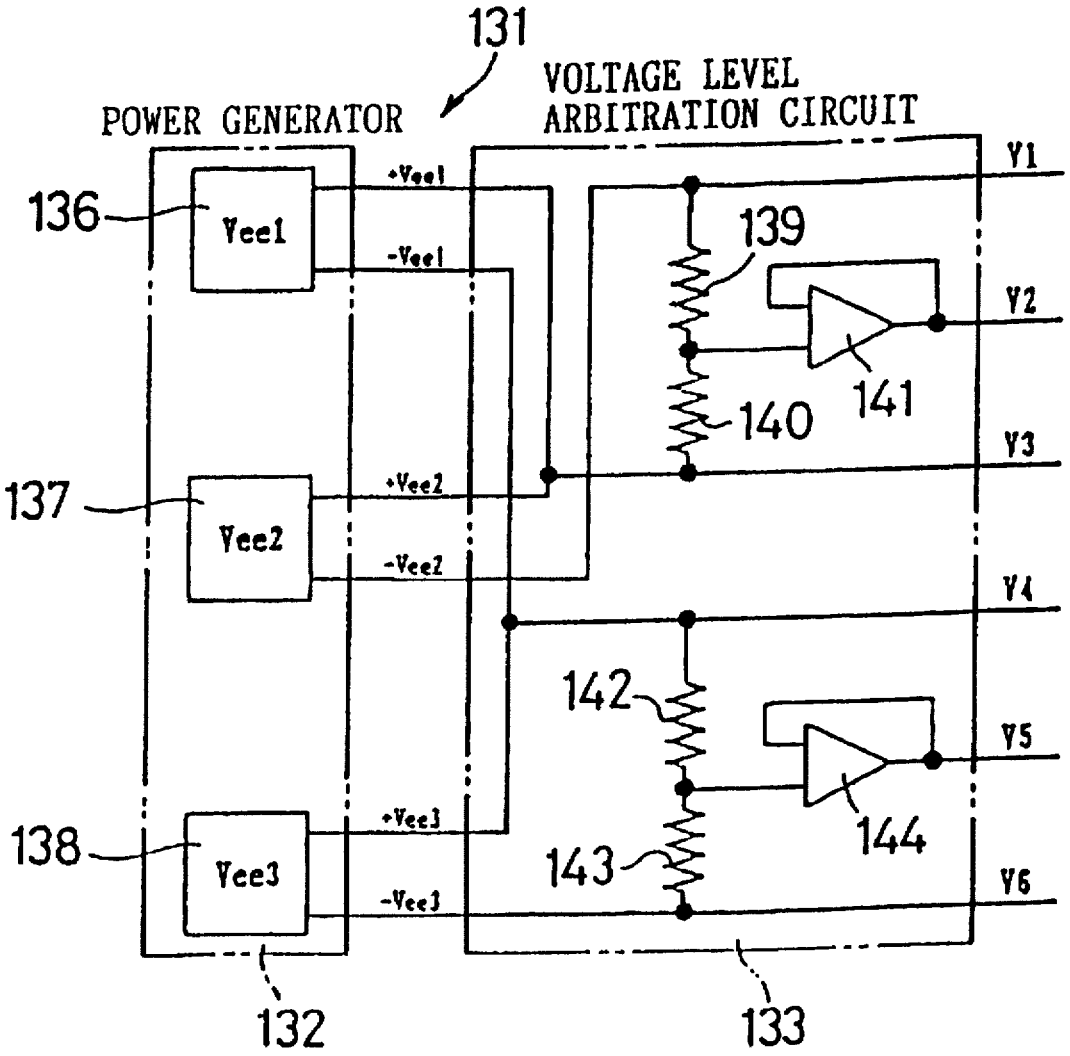
FIG. 9 is a circuit diagram of a power circuit in accordance with a fifth embodiment of the invention.

FIG. 9 is a block diagram illustrating a power circuit 131 in accordance with a fifth embodiment of the invention. In this embodiment, a power generator 132 has first, second and third power supplies 136 to 138. In a voltage level arbitration circuit 133, a high potential +Vee1 of the first power supply 136 is connected to a low potential −Vee2 of the second power supply 137, and a low potential −Vee1 of the first power supply 136 is connected to a high potential +Vee3 of the third power supply 138 to generate potentials required for driving the liquid crystal display panel 25.

Referring to FIG. 9, the power supplies 136 to 138 for delivering potentials Vee1, Vee2 and Vee3 are electrically isolated power supplies, such as dry cells and DC/DC converters. The relationship of the voltages of the power supplies 137, 138 is Vee2=Vee3. In the voltage level arbitration circuit 133, +Vee1 and −Vee2 having an identical potential are connected to each other, and −Vee1 and +Vee3 having an identical potential are also connected to each other. The potentials delivered from the power supplies 136 to 138 have relationship of +Vee2>−Vee2=+Vee1>−Vee1=Vee3>−Vee3, and the potentials are delivered as potentials V1, V3, V4 and V6, respectively.

The difference between the potentials V1 and V3 is divided by resistors 139 and 140 to obtain an intermediate potential between the two potentials, and the intermediate potential is current-amplified by an operational amplifier 141 and delivered as potential V2. Furthermore, the difference between the potentials V4 and V6 is divided by resistors 142 and 143 to obtain an intermediate potential between the two potentials, and the intermediate potential is current-amplified by an operational amplifier 144 and delivered as potential V5.

In the power circuit 131, when current flows between the potentials V1 and V3, the power supply 137 operates as a power supply, and power to be consumed amounts to current value×(difference between the potentials V1 and V3). When current flows between the potentials V4 and V6, the power supply 138 operates as a power supply, and power to be consumed amounts to a current value×(difference between the potentials V4 and V6). When current flows between the potentials V1 and V4, V5 or V6, or when current flows between the potentials V1, V2 or V3 and V6, the power supplies 136, 137 and 138 operate as power supplies.

As described above, in accordance with the fifth embodiment of the invention, when current flows between the potentials V1 and V3, only the power supply 137 for delivering the potentials V1 to V3 operates as a power supply. Therefore, power consumption due to the potential difference between the potentials V4 and V6 having been consumed wastefully by the conventional power circuit can be eliminated. In the same way, when current flows between the potentials V4 and V6, only the power supply 138 for delivering potentials V4 to V6, operates as a power supply. Therefore, power consumption due to the potential difference between the potentials V1 and V3 having been consumed wastefully can be eliminated.

Figure 10:
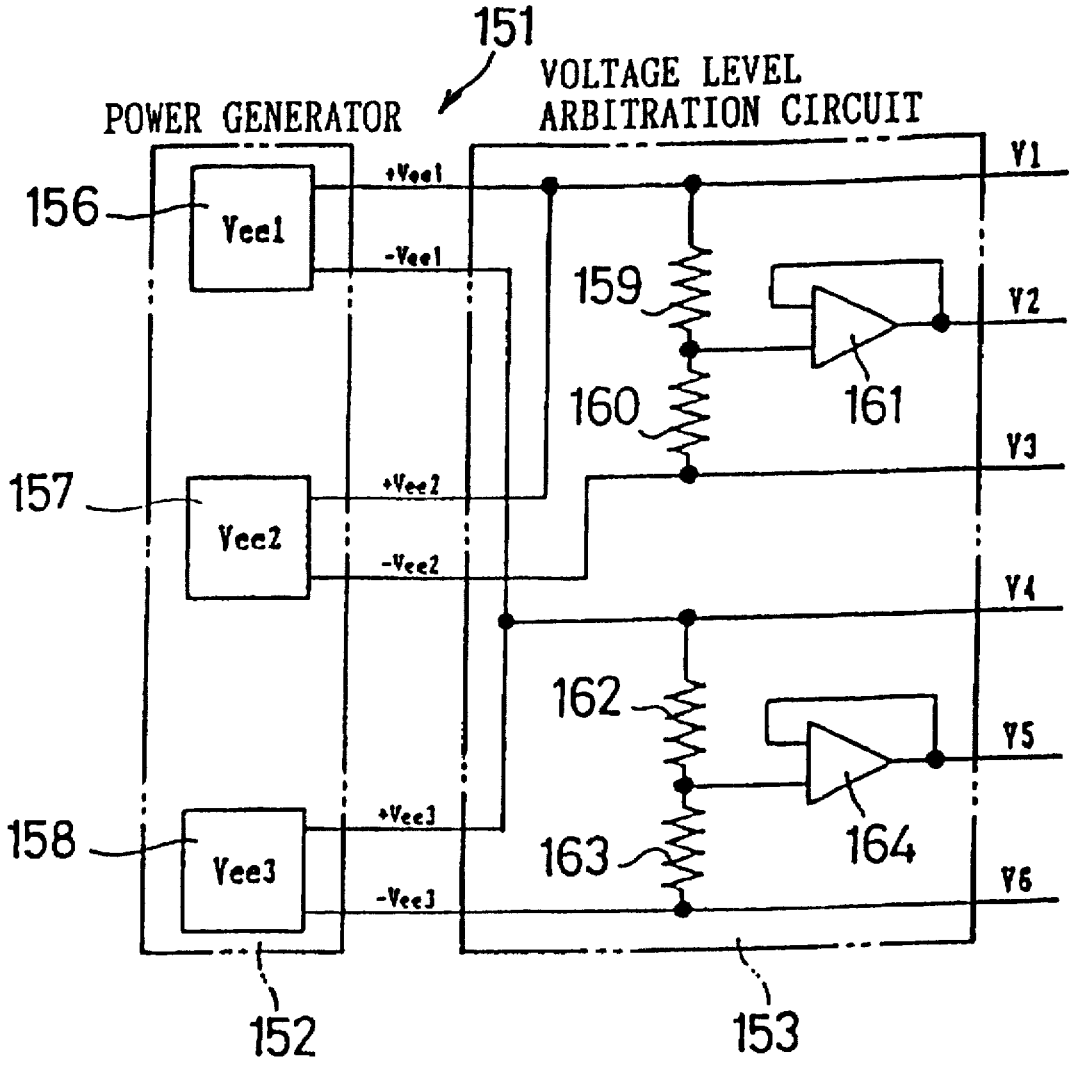
FIG. 10 is a circuit diagram of a power circuit in accordance with a sixth embodiment of the invention.

FIG. 10 is a diagram illustrating a power circuit 151 in accordance with a sixth embodiment of the invention. In this embodiment, a power generator 152 has first, second and third power supplies 156 to 158. In a voltage level arbitration circuit 153, high potential +Vee1 of the first power supply 156 is connected to high potential +Vee2 of the second power supply 157, and low potential −Vee1 of the first power supply 156 is connected to a high potential +Vee3 of the power supply 158 to generate potentials required for driving the liquid crystal display panel 25.

Referring to FIG. 10, the power supplies 156 to 158 for delivering potentials Vee1, Vee2 and Vee3 are electrically isolated power supplies, such as dry cells and DC/DC converters. The relationship of the voltages (each voltage: a difference between +potential and −potential) of the power supplies 156 to 158 is Vee1>Vee2=Vee3. In the voltage level arbitration circuit 153, +Vee1 and +Vee2 having an identical potential are connected to each other, and −Vee1 and +Vee3 having an identical potential are also connected to each other. The potentials delivered from the power supplies 156 to 158 have relationship of +Vee1=+Vee2>−Vee2>−Vee1=+Vee3>−Vee3, and the potentials are delivered as potentials V1, V3, V4 and V6, respectively.

The difference between the potentials V1 and V3 is divided by resistors 159 and 160 to obtain an intermediate potential between the two potentials, and the intermediate potential is current-amplified by an operational amplifier 161 and delivered as potential V2. Furthermore, the difference between potentials V4 and V6 is divided by resistors 162 and 163 to obtain an intermediate potential between the two potentials, and the intermediate potential is current-amplified by an operational amplifier 164 and delivered as potential V5.

In the power circuit 151, when current flows between the potentials V1 and V3, the power supply 157 operates as a power supply, and power to be consumed amounts to current value×(difference between the potentials V1 and V3). When current flows between the potentials V4 and V6, the power supply 158 operates as a power supply, and power to be consumed amounts to current value×(difference between the potentials V4 and V6). When current flows between the potentials V1 and V4, V5 or V6, or when current flows between the potentials V1, V2 or V3 and V6, the power supplies 156 and 158 operate as power supplies.

As described above, in accordance with the sixth embodiment of the invention, when current flows between the potentials V1 and V3, only the power supply 157 for delivering the potentials V1 to V3, operates as a power supply. Therefore, power consumption due to the potential difference between potentials V4 and V6 having been consumed wastefully by the conventional power circuit can be eliminated. In the same way, when current flows between the potentials V4 and V6, the power supply 158 for delivering potentials V4 to V6 operates as a power supply. Therefore, power consumption due to the potential difference between the potentials V1 and V3 having been consumed wastefully can be eliminated.

In the sixth embodiment of the invention, the potentials delivered from the power circuits 156 to 158 are set to have relationship of +Vee1=+Vee2 and −Vee1=+Vee3, and +Vee1 and +Vee2 are connected to each other and −Vee1 and +Vee3 are also connected to each other, in the voltage arbitration circuit 153. However, as another structure, the potentials delivered from the power circuits 156 to 158 are set to have relationship of +Vee1=−Vee2 and −Vee1=−Vee3, and +Vee1 and −Vee2 may be connected to each other and −Vee1 and −Vee3 may also be connected to each other in the voltage arbitration circuit 153.

Figure 11:
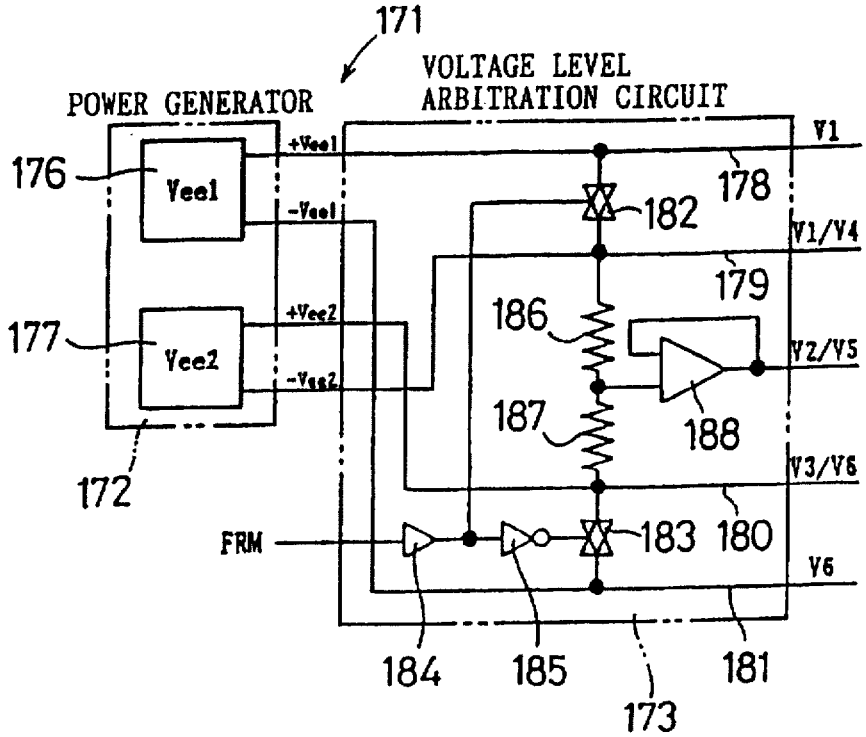
FIG. 11 is a circuit diagram of a power circuit in accordance with a seventh embodiment of the invention.
Figure 12:
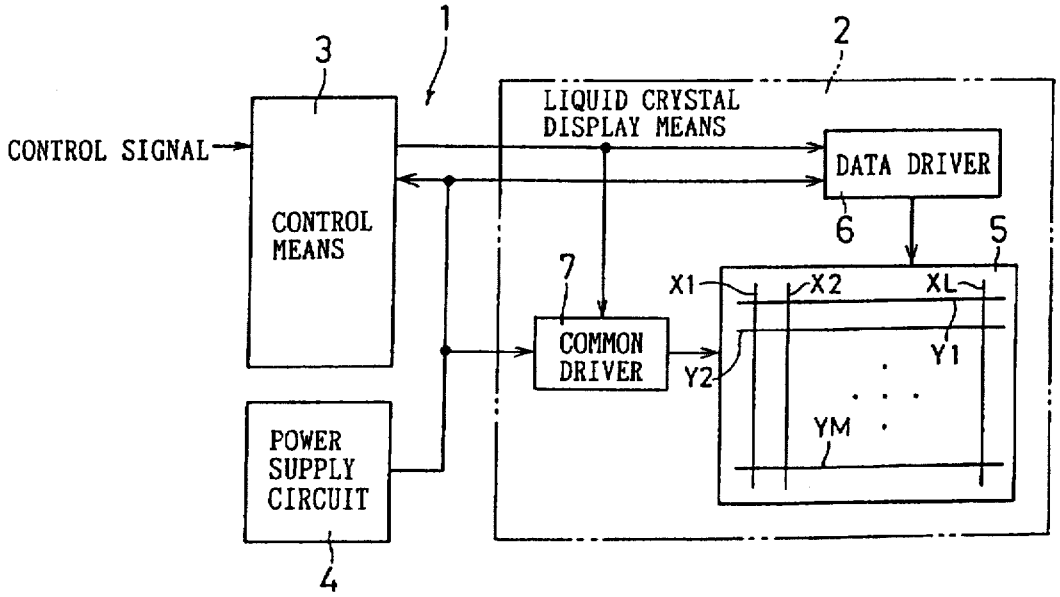
Fig. 12 (Prior Art)
FIG. 12 is a block diagram showing a structure of a liquid crystal display device 1 in accordance with a typical conventional embodiment.
Figure 13:
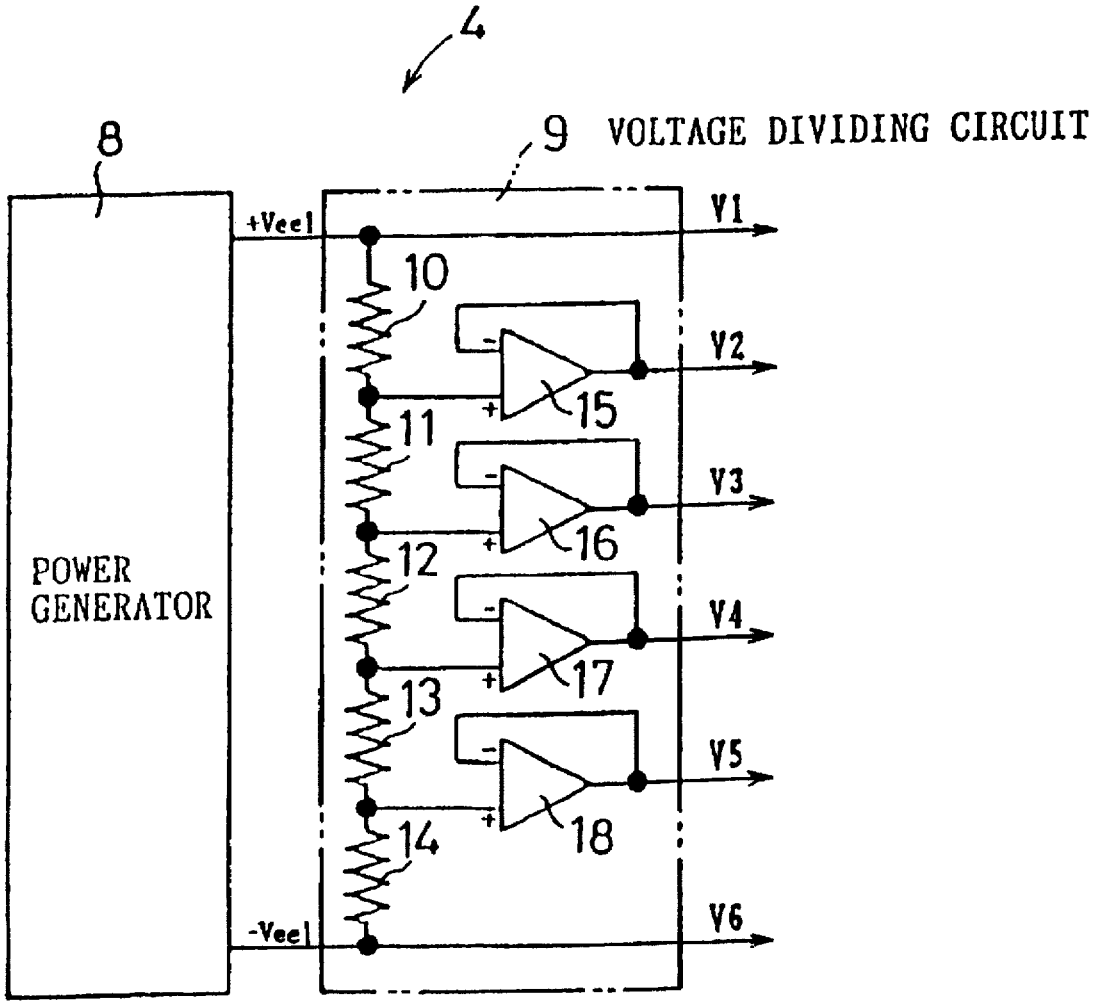
Fig. 13 (Prior Art)
FIG. 13 is a circuit diagram of a power circuit 4.

FIG. 11 is a block diagram illustrating a power circuit 171 in accordance with a seventh embodiment of the invention. In this embodiment, a power generator 172 has first and second power supplies 175, 177. In a voltage level arbitration circuit 173, first and second analog switches 182, 183 are turned on and off on the basis of a signal for specifying an alternating period to generate potentials required for driving the liquid crystal display panel 25.

Referring to FIG. 11, the power supplies 176, 177 for delivering potentials Vee1, Vee2 are electrically isolated power supplies, such as dry cells and DC/DC converters. The relationship of the voltages (each voltage: a difference between +potential and −potential) of the power supplies 176, 177 is Vee1>Vee2.

The voltage level arbitration circuit 173 comprises signal lines 178 to 181, the first and second analog switches 182, 183, operational amplifiers 184, 188, an inverter 185 and resistors 186, 187.

The analog switch 182 is disposed between the signal lines 178 and 179, and the analog switch 183 is disposed between the signal lines 180 and 181. The signal FRM for specifying the alternating period is amplified by the operational amplifier 184 and supplied to the analog switch 182, and a signal obtained by inverting the signal FRM by means of the inverter 185 is supplied to the analog switch 183. In other words, either the analog switch 182 or the analog switch 183 is turned on by the signal FRM.

When the signal FRM is at low level as shown in FIG. 2, potentials to be applied to the electrodes Le and Ls of the liquid crystal display panel 25 are the potentials V1, V4, V5 and V6. When signal FRM is at high level, potentials to be applied to the electrodes Lc and Ls of the liquid crystal display panel 25 are potentials V1, V2, V3 and V6. Therefore, four potentials should be delivered for each level of the signal FRM when the liquid crystal display panel 25 is driven as if using alternating current.

When the analog switch 182 is turned on by the signal FRM, the potential V1 is delivered from the signal lines 178, 179, and the potential V3 is delivered from the signal line 180, and the potential V6 is delivered from the signal line 181. The difference between the potential V1 of the signal line 179 and the potential V3 of the signal line 180 is divided by resistors 186, 187 to obtain an intermediate potential between the two potentials, and the intermediate potential is current-amplified by an operational amplifier 188 and delivered as the potential V2.

Additionally a switch (not shown) is provided between the contact of the signal line 179 with the analog switch 182 and the power supply 177. When the analog switch 182 is turned on, the switch is turned off and the potential V1 is delivered from the signal line 179. When the analog switch 182 is turned off, the switch is turned on and the potential V4 is outputted from the signal line 179.

When the analog switch 183 is turned on by the signal FRM, the potential V1 is delivered from the signal line 178, and the potential V4 is delivered from the signal line 179, and the potential V6 is delivered from the signal lines 180, 181. The difference between the potential V4 of the signal line 179 and the potential V6 of the signal line 180 is divided by the resistors 186, 187 to obtain an intermediate potential between the two potentials, and the intermediate potential is current-amplified by the operational amplifier 188 and delivered as the potential Additionally a switch (not shown) is provided between the contact of the signal line 180 with the analog switch 183 and the power supply 176. When the analog switch 183 is turned on, the switch is turned off and the potential V6 is delivered from the signal line 180. When the analog switch 183 is turned off, the switch is turned on and the potential V3 is outputted from the signal line 180.

In the power circuit 171, when the analog switch 182 is on and current flows between the potentials V1 and V3, the power supply 177 operates as a power supply. Therefore, power to be consumed amounts to current value×(difference between the potentials V1 and V3). Even when the analog switch 183 is on and current flows between the potentials V4 and V6, the power supply 177 operates as a power supply. Therefore, power to be consumed amounts to current value× (difference between the potentials V4 and V6). When current flows between potentials V1 and V4, V5 or V6, or between potentials V1, V2 or V3 and V6, the power supply 176 operates as a power supply.

As described above, in accordance with the seventh embodiment of the invention, in case either the analog switch 182 or the analog switch 183 is turned on by the signal FRM for specifying the alternating period, when current flows between the potentials V1 and V3, and between the potentials V4 and V6, the power supply 177 for delivering a voltage lower than the voltage of the power supply 176 operates as a power supply. Therefore, power consumption due to the potential differences between the potentials V1 and V3, and between the potentials V4 and V6 having been consumed wastefully can be eliminated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A liquid crystal display device comprising:

a liquid crystal display panel;

power supply circuit for generating six potentials V1 to V6 (V1>V2>V3>V4>V5>V6); and a driver for selecting at least two potentials from the six potentials generated from the power supply circuit depending on an image to be displayed on the liquid crystal display panel and for supplying voltages to the liquid crystal display panel, the driver comprising scanning electrode driving means for applying a selection potential to the scanning electrodes sequentially in order of line arrangement at every predetermined horizontal scanning period within a predetermined vertical scanning period, for applying a nonselection potential to the scanning electrodes to which the selection potential is not applied, for selecting the first and sixth potentials V1, V6 supplied from the power supply means as the selection potentials, on the basis of an alternating signal for specifying a timing for inverting the polarity of voltage to be applied to the liquid crystal display panel, and for selecting the fifth and second potentials V5, V2 supplied from the power supply means as the nonselection potentials, on the basis of the alternating signal;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6; and signal electrode driving means for selectively applying an ON or OFF potential to the signal electrodes of the liquid crystal display panel on the basis of data to be displayed at the pixels of the liquid crystal display panel, for selecting the sixth and first potentials V6, V1 supplied from the power supply circuit as the ON potentials, on the basis of the alternating signal, and for selecting the fourth and third potentials V4, V3 supplied from the power supply circuit as the OFF potentials on the basis of the alternating signal.

2. A liquid crystal display device comprising:

a liquid crystal display panel;

power supply circuit for generating six potentials V1 to V6 (V1>V2>V3>V4>V5>V6); and a driver for selecting at least two potentials from the six potentials generated from the power supply circuit depending on an image to be displayed on the liquid crystal display panel and for supplying voltages to the liquid crystal display panel, the driver comprising an scanning electrode driver for applying a selection potential to the scanning electrodes sequentially in order of line arrangement at every predetermined horizontal scanning period within a predetermined vertical scanning period, for applying a nonselection potential to the scanning electrodes to which the selection potential is not applied, for selecting the first and sixth potentials V1, V6 supplied from the power supply circuit as the selection potentials, on the basis of an alternating signal for specifying a timing for inverting the polarity of voltage to be applied to the liquid crystal display panel, and for selecting the fifth and second potentials V5, V2 supplied from the power supply circuit as the nonselection potentials, on the basis of the alternating signal;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6; and a signal electrode driver for selectively applying an ON or OFF potential to the signal electrodes of the liquid crystal display panel on the basis of data to be displayed at the pixels of the liquid crystal display panel, for selecting the sixth and first potentials V6, V1 supplied from the power supply circuit as the ON potentials, on the basis of the alternating signal, and for selecting the fourth and third potentials V4, V3 supplied from the power supply circuit as the OFF potentials on the basis of the alternating signal.

3. A liquid crystal display device comprising:

a liquid crystal display panel;

power supply circuit for generating six potentials V1 to V6 (V1>V2>V3>V4>V5>V6); and a driver for selecting at least two potentials from the six potentials generated from the power supply circuit depending on an image to be displayed on the liquid crystal display panel and for supplying voltages to the liquid crystal display panel, the driver comprising a scanning electrode driver for applying a selection potential to the scanning electrodes sequentially in order of line arrangement at every predetermined horizontal scanning period within a predetermined vertical scanning period, for applying a nonselection potential to the scanning electrodes to which the selection potential is not applied, for selecting the first and sixth potentials V1, V6 supplied from the power supply circuit as the selection potentials, on the basis of an alternating signal for specifying a timing for inverting the polarity of voltage to be applied to the liquid crystal display panel, and for selecting the fifth and second potentials V5, V2 supplied from the power supply circuit as the nonselection potentials, on the basis of the alternating signal;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6; and a signal electrode driver for selectively applying an ON or OFF potential to the signal electrodes of the liquid crystal display panel on the basis of data to be displayed at the pixels of the liquid crystal display panel, for selecting the sixth and first potentials V6, V1 supplied from the power supply circuit as the ON potentials, on the basis of the alternating signal, and for selecting the fourth and third potentials V4, V3.

4. A liquid crystal display device comprising:

a liquid crystal display panel;

power supply circuit for generating six potentials V1 to V6 (V1>V2>V3>V4>V5>V6); and a driver for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a voltage level arbitration circuit for creating and delivering the six potentials V1 to and V6 on the basis of outputs from the first and second power supplies;

the voltage level arbitration circuit comprising:

a first signal line to which the potential V1 is supplied;

a second signal line to which the potential V4 is supplied;

a third signal line to which the potential V3 is supplied;

a fourth signal line to which the potential V6 is supplied;

a first switching element disposed between the first and second signal lines, turned on and off by an alternating signal for specifying a timing for inverting the polarity of the voltage to be applied to the liquid crystal display panel; and a second switching element disposed between the third and fourth signal lines, turned on and off by the inverting signal of the alternating signal.

5. The liquid crystal display device of claim 4, wherein the liquid crystal display panel is formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels, and the driver comprises:

a scanning electrode driver for applying a selection potential to the scanning electrodes sequentially in order of line arrangement at every predetermined horizontal scanning period within a predetermined vertical scanning period, for applying a nonselection potential to the scanning electrodes to which the selection potential is not applied, for selecting the first and sixth potentials V1, V6 supplied from the power supply circuit as the selection potentials, on the basis of an alternating signal for specifying a timing for inverting the polarity of voltage to be applied to the liquid crystal display panel, and for selecting the fifth and second potentials V5, V2 supplied from the power supply circuit as the nonselection potentials, on the basis of the alternating signal; and a signal electrode driver for selectively applying an ON or OFF potential to the signal electrodes of the liquid crystal display panel on the basis of data to be displayed at the pixels of the liquid crystal display panel, for selecting the sixth and first potentials V6, V1 supplied from the power supply circuit as the ON potentials, on the basis of the alternating signal, and for selecting the fourth and third potentials V4, V3 supplied from the power supply circuit as the OFF potentials on the basis of the alternating signal.

6. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

a scanning electrode driver for applying either one of first and second selection potentials having an equal potential difference from a predetermined reference potential to the scanning electrodes sequentially in order of line arrangement at every predetermined horizontal scanning period within a predetermined vertical scanning period, and for applying a nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

the liquid crystal display device further comprising:

a switching circuit provided between the liquid crystal display panel and the scanning electrode driver, the switching circuit having switching elements for turning on and off the electric connection between the scanning electrodes adjacent to each other; and a control circuit which provides an instruction to the scanning electrode driver so as to isolate (1) a scanning electrode, to which the selection potential has been applied, and (2) a scanning electrode, to which the selection potential is to be applied next, for a predetermined period after the horizontal scanning period, and for turning on a switching element provided between the scanning electrode, to which the selection potential has been applied, and the scanning electrode to which the selection potential is to be applied next, for the predetermined period.

7. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

a scanning electrode driver for applying either one of first and second selection potentials having an equal potential difference from a predetermined reference potential to the scanning electrodes sequentially in order of line arrangement at every predetermined horizontal scanning period within a predetermined vertical scanning period, and for applying a nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

the liquid crystal display device further comprising:

a switching circuit provided between the liquid crystal display panel and the signal electrode driver, the switching circuit being provided with switching elements for turning on and off the electric connections between the signal electrodes adjacent to each other; and a control circuit which provides an instruction to the signal electrode driver so as to isolate all the signal electrodes for a predetermined period after the horizontal scanning period, and for turning on all the switching elements of the second switching circuit for the predetermined period.

8. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

a scanning electrode driver supplied with first and second potentials V1, V6 having an equal potential difference from a predetermined reference potential and first and second nonselection potentials V5, V2 having an equal potential difference from the predetermined reference potential and a difference potential from the first and second potentials V1, V6, for applying for applying either one of the selection potentials to the scanning electrodes sequentially in order of line arrangement at every predetermined horizontal scanning period within a predetermined vertical scanning period, and for applying the nonselection potential to the remaining scanning electrodes to which the selection potential is not applied;

a signal electrode driver supplied with first and second ON potentials V6, V1 having an equal potential difference from the reference potential and first and second OFF potentials V4, V3 having an equal potential difference from the reference potential and a different potential from the first and second ON potentials, for applying a selected one of the ON potentials or a selected one of the OFF potentials, to signal electrodes on the basis of data to be displayed at the pixels corresponding to the scanning electrodes to which either one of the selection potentials is applied within the horizontal scanning period; and a power supply circuit for generating six potentials V1 to V6 (V1>V2>V3>V4>V5>V6); and the liquid crystal display device further comprising:

a switching circuit provided between the liquid crystal display panel and the scanning electrode driver, the switching circuit having switching elements for turning on and off the electric connection between the scanning electrodes adjacent to each other; and a control circuit which provides an instruction to the scanning electrode driver so as to isolate (1) a scanning electrode, to which the selection potential has been applied, and (2) a scanning electrode, to which the selection potential is to be applied next, for a predetermined period after the horizontal scanning period, for a predetermined period after the horizontal scanning period, and for turning on a switching element provided between the scanning electrode, to which the selection potential has been applied, and the scanning electrode to which the selection potential is to be applied next, for the predetermined period.

9. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

a scanning electrode driver supplied with first and second potentials V1, V6 having an equal potential difference from a predetermined reference potential and first and second nonselection potentials V5, V2 having an equal potential difference from the predetermined reference potential and a difference potential from the first and second potentials, for applying for applying either one of the selection potentials to the scanning electrodes sequentially in order of line arrangement at every predetermined horizontal scanning period within a predetermined vertical scanning period, and for applying the nonselection potential to the remaining scanning electrodes to which the selection potential is not applied;

a signal electrode driver supplied with first and second ON potentials V6, V1 having an equal potential difference from the reference potential and first and second OFF potentials V4, V3 having an equal potential difference from the reference potential and a different potential from the first and second ON potentials, for applying a selected one of the ON potentials or a selected one of the OFF potentials, to signal electrodes on the basis of data to be displayed at the pixels corresponding to the scanning electrodes to which either one of the selection potentials is applied within the horizontal scanning period; and a power supply circuit for generating six potentials V1 to V6 (V1>V2>V3>V4>V5>V6); and the liquid crystal display device further comprising:

a switching circuit provided between the liquid crystal display panel and the signal electrode driver, the switching circuit being provided with switching elements for turning on and off the electric connections between the signal electrodes adjacent to each other; and a control circuit which provides an instruction to the signal electrode driver so as to isolate all the signal electrodes for a predetermined period after the horizontal scanning period, and for turning on all the switching elements of the second switching circuit for the predetermined period.

10. The liquid crystal display device of claim 8, the device including a second switching circuit provided with switching elements for turning on and off the electric connections between the signal electrodes adjacent to each other, the switching elements being disposed between the liquid crystal display panel and the signal electrode driver; and wherein the control provides an instruction to the signal electrode driving circuit so as to isolate all the signal electrodes for a predetermined period after the horizontal scanning period, and turns on all the switching elements of the second switching circuit for the predetermined period.

11. The liquid crystal display device of claim 8 or 9, wherein the power supply means includes:

five power supplies for generating a high potential Vi and low potentials Vi+1 (i=1 to 5); and a voltage level arbitration circuit for delivering potentials V1 to V6 by commonly connecting equal potentials among the potentials from the power supplies.

12. The liquid crystal display device of claim 8 or 9, wherein the power supply circuit includes:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6.

13. The liquid crystal display device of claim 8 or 9, wherein the power supply circuit includes:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6.

14. The liquid crystal display device of claim 8 or 9, wherein the power supply circuit includes:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6.

15. The liquid crystal display device of claim 8 or 9, wherein the power supply circuit includes:

a first power supply unit;

a second power supply unit;

a voltage level arbitration circuit for creating and delivering the six potentials V1 to and V6 on the basis of outputs from the first and second power supplies;

the voltage level arbitration circuit comprising:

a first signal line to which the potential V1 is supplied;

a second signal line to which the potential V4 is supplied;

a third signal line to which the potential V3 is supplied;

a fourth signal line to which the potential V6 is supplied;

a first switching element disposed between the first and second signal lines, turned on and off by an alternating signal for specifying a timing for inverting the polarity of the voltage to be applied to the liquid crystal display panel; and a second switching element disposed between the third and fourth signal lines, turned on and off by the inverting signal of the alternating signal.

16. The liquid crystal display device of any one of claims 4, 5, 8 and 9, wherein the following ratios express respective potentials delivered from the power supply circuit: (difference between V1 and V2): (difference between V2 and V3): (difference between V3 and V4): (difference between V4 and V5): (difference between V5 and V6)= 1:1:1:1:1.

17. The liquid crystal display device of any one of claims 4, 5, 8 and 9, wherein the following ratios express respective potentials delivered from the power supply circuit: (difference between V1 and V2): (difference between V2 and V3): (difference between V3 and V4): (difference between V4 and V5): (difference between V5 and V6)= 1:1:9:1:1.

18. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

a power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a switching circuit provided between the liquid crystal display panel and the scanning electrode driver, the switching circuit having switching elements for turning on and off the electric connection between the scanning electrodes adjacent to each other; and a control circuit which provides an instruction to the scanning electrode driver so as to isolate (1) a scanning electrode, to which the selection potential has been applied, and (2) a scanning electrode, to which the selection potential is to be applied next, for a predetermined period after the horizontal scanning period, and for turning on a switching element provided between the scanning electrode, to which the selection potential has been applied, and the scanning electrode to which the selection potential is to be applied next, for the predetermined period.

19. A liquid crystal display device comprising:

a liquid crystal display panel formed by interposing a liquid crystal layer between a plurality of scanning electrodes and a plurality of signal electrodes, the scanning electrodes and the signal electrodes being disposed to intersect with one another, so as to use the intersections of the scanning electrodes and the signal electrodes as pixels;

power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a switching circuit provided between the liquid crystal display panel and the signal electrode driver, the switching circuit being provided with switching elements for turning on and off the electric connections between the signal electrodes adjacent to each other; and a control circuit which provides an instruction to the signal electrode driver so as to isolate all the signal electrodes for a predetermined period after the horizontal scanning period, and for turning on all the switching elements of the second switching circuit for the predetermined period.

20. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a switching circuit provided between the liquid crystal display panel and the scanning electrode driver, the switching circuit having switching elements for turning on and off the electric connection between the scanning electrodes adjacent to each other; and a control circuit which provides an instruction to the scanning electrode driver so as to isolate (1) a scanning electrode, to which the selection potential has been applied, and (2) a scanning electrode, to which the selection potential is to be applied next, for a predetermined period after the horizontal scanning period, and for turning on a switching element provided between the scanning electrode, to which the selection potential has been applied, and the scanning electrode to which the selection potential is to be applied next, for the predetermined period.

21. A liquid crystal display device comprising:

a liquid crystal display panel formed by interposing a liquid crystal layer between a plurality of scanning electrodes and a plurality of signal electrodes, the scanning electrodes and the signal electrodes being disposed to intersect with one another, so as to use the intersections of the scanning electrodes and the signal electrodes as pixels;

power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a control circuit which provides an instruction to the signal electrode driver so as to isolate all the signal electrodes for a predetermined period after the horizontal scanning period, and for turning on all the switching elements of the second switching circuit for the predetermined period.

22. A liquid crystal display device comprising:

a liquid crystal display panel formed by interposing a liquid crystal layer between a plurality of signal electrodes and a plurality of scanning electrodes, the signal electrodes and the scanning electrodes being disposed to intersect with one another, so as to use the intersections of the signal electrodes and the scanning electrodes as pixels;

power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a switching circuit provided between the liquid crystal display panel and the scanning electrode driver, the switching circuit having switching elements for turning on and off the electric connection between the scanning electrodes adjacent to each other; and a control circuit which provides an instruction to the scanning electrode driver so as to isolate (1) a scanning electrode, to which the selection potential has been applied, and (2) a scanning electrode, to which the selection potential is to be applied next, for a predetermined period after the horizontal scanning period, and for turning on a switching element provided between the scanning electrode, to which the selection potential has been applied, and the scanning electrode to which the selection potential is to be applied next, for the predetermined period.

23. A liquid crystal display device comprising:

a liquid crystal display panel formed by interposing a liquid crystal layer between a plurality of scanning electrodes and a plurality of signal electrodes, the scanning electrodes and the signal electrodes being disposed to intersect with one another, so as to use the intersections of the scanning electrodes and the signal electrodes as pixels;

power supply circuit for generating six potentials V1 to V6 (V1>V2>V3>V4>V5>V6), the power supply circuit comprising:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

a scanning electrode driver for selecting at least one of the six potentials V1 to V6 as a selection potential and at least one of the six potentials V1 to V6 as a nonselection potential and for applying the selected to the scanning electrodes sequentially in order of line arrangement at every predetermined horizontal scanning period within a predetermined vertical scanning period, and for applying the nonselection potential to the remaining scanning electrodes to which the selection potential is not applied; and a signal electrode driver for applying an ON potential or an OFF potential to the signal electrodes on the basis of data to be displayed at the pixels corresponding to the scanning electrodes to which either one of the selection potentials is applied within the horizontal scanning period;

a control circuit which provides an instruction to the signal electrode driver so as to isolate all the signal electrodes for a predetermined period after the horizontal scanning period, and for turning on all the switching elements of the second switching circuit for the predetermined period.

24. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

wherein the following ratios express respective potentials delivered from the power supply circuit: (difference between V1 and V2): (difference between V2 and V3): (difference between V3 and V4): (difference between V4 and V5): (difference between V5 and V6)= 1:1:1:1:1.

25. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V6, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

wherein the following ratios express respective potentials delivered from the power supply circuit: (difference between V1 and V2): (difference between V2 and V3): (difference between V3 and V4): (difference between V4 and V5): (difference between V5 and V6)= 1:1:9:1:1.

26. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

wherein the following ratios express respective potentials delivered from the power supply circuit: (difference between V1 and V2): (difference between V2 and V3): (difference between V3 and V4): (difference between V4 and V5): (difference between V5 and V6)= 1:1:1:1:1.

27. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V3 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

wherein the following ratios express respective potentials delivered from the power supply circuit: (difference between V1 and V2): (difference between V2 and V3): (difference between V3 and V4): (difference between V4 and V5): (difference between V5 and V6)= 1:1:9:1:1.

28. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6; wherein the following ratios express respective potentials delivered from the power supply circuit: (difference between V1 and V2): (difference between V2 and V3): (difference between V3 and V4): (difference between V4 and V5): (difference between V5 and V6)=1:1:1:1:1.

29. A liquid crystal display device comprising:

a liquid crystal display panel;

power supply circuit for generating six potentials V1 to V6 (V1>V2>V3>V4>V5>V6); and a driving circuit for selecting at least two potentials from the six potentials generated from the power supply circuit depending on an image to be displayed on the liquid crystal display panel and for supplying voltages to the liquid crystal display panel;

wherein the power supply circuit comprises:

a first power supply unit;

a second power supply unit;

a third power supply unit; and a voltage level arbitration circuit for generating the potentials V1, V2, V3, V4 V5, and V6, outputs from the first power supply unit being utilized by the voltage level arbitration circuit to generate the potential V1 and the potential V4, outputs from the second power supply unit being utilized by the voltage level arbitration circuit to generate the potential V1 and the potential V3, outputs from the third power supply unit being utilized by the voltage level arbitration circuit to generate the potential V4 and the potential V6, the potential V2 being generated by the voltage level arbitration circuit by dividing the difference between potentials V1 and V3, the potential V5 being generated by the voltage level arbitration circuit by dividing the difference between potentials V4 and V6;

wherein the following ratios express respective potentials delivered from the power supply circuit: (difference between V1 and V2): (difference between V2 and V3): (difference between V3 and V4): (difference between V4 and V5): (difference between V5 and V6)= 1:1:9:1:1.

* * * * *